US009595430B2

(12) United States Patent
Furtaw et al.

(10) Patent No.: US 9,595,430 B2
(45) Date of Patent: Mar. 14, 2017

(54) LASER DESORPTION IONIZATION MASS SPECTROMETRY USING A PARTICULATE SEPARATION BED

(71) Applicant: LI-COR, Inc., Lincoln, NE (US)

(72) Inventors: Michael D. Furtaw, Lincoln, NE (US); Jon P. Anderson, Lincoln, NE (US); Mary J. Wirth, West Lafayette, IN (US); Robert E. Birdsall, West Lafayette, IN (US); Yimin Hua, Arlington, MA (US); Zhaorui Zhang, Richland, WA (US)

(73) Assignees: LI-COR, INC., Lincoln, NE (US); Purdue Research Foundation, West Lafayette, IN (US)

( * ) Notice: Subject to any disclaimer, the term of this patent is extended or adjusted under 35 U.S.C. 154(b) by 180 days.

(21) Appl. No.: 14/668,485

(22) Filed: Mar. 25, 2015

(65) Prior Publication Data

US 2015/0279648 A1 Oct. 1, 2015

Related U.S. Application Data

(60) Provisional application No. 61/970,857, filed on Mar. 26, 2014, provisional application No. 61/970,818, filed on Mar. 26, 2014.

(51) Int. Cl.
*H01J 49/16* (2006.01)
*H01J 49/00* (2006.01)

(52) U.S. Cl.
CPC ..... *H01J 49/164* (2013.01); *H01J 49/0027* (2013.01)

(58) Field of Classification Search
CPC ..... H01J 49/64; H01J 49/00271
See application file for complete search history.

(56) References Cited

U.S. PATENT DOCUMENTS

2002/0034827 A1 3/2002 Singh et al.
2002/0146745 A1 10/2002 Natan et al.
(Continued)

FOREIGN PATENT DOCUMENTS

AL 2005/088292 A1 9/2005

OTHER PUBLICATIONS

Anderson et al., "A Human Proteome Detection and Quantitation Project," Molecular & Cellular Proteomics, 2009, vol. 8, pp. 883-886.

(Continued)

*Primary Examiner* — Wyatt Stoffa
*Assistant Examiner* — Sean Luck
(74) *Attorney, Agent, or Firm* — Kilpatrick Townsend and Stockton LLP

(57) ABSTRACT

A self-assembled engineered lattice of nanometer-scale silica particles, or other suitable particles generally resembling regularly-sized spheres, is configured in a separation bed for electrophoresis, isoelectric focusing, chromatography, or other voltage-induced separation of analytes. After separation, the analytes are immobilized on the separation bed and then ionized using matrix-assisted laser desorption/ionization (MALDI) for use with a mass spectrometer. The nanoparticles can be coated with polymers that activate to immobilize the analytes or assist with MALDI. The separation can occur in two dimensions.

18 Claims, 18 Drawing Sheets

STEP 5: DETECTION

(56) References Cited

U.S. PATENT DOCUMENTS

| | | | | |
|---|---|---|---|---|
| 2004/0058457 | A1 | 3/2004 | Huang et al. | |
| 2005/0037516 | A1 | 2/2005 | Schmucker et al. | |
| 2006/0147344 | A1 | 7/2006 | Ahn et al. | |
| 2006/0180469 | A1* | 8/2006 | Han | G01N 27/44791 204/601 |
| 2007/0017870 | A1* | 1/2007 | Belov | G01N 30/56 210/656 |
| 2008/0193772 | A1 | 8/2008 | Agroskin et al. | |
| 2009/0152201 | A1* | 6/2009 | Wirth | B01J 20/28007 210/656 |
| 2009/0242406 | A1* | 10/2009 | Han | B01L 3/502707 204/520 |
| 2010/0048814 | A1 | 2/2010 | Polk | |
| 2010/0062539 | A1 | 3/2010 | Frederick et al. | |
| 2010/0178505 | A1* | 7/2010 | Rutledge | D01D 5/0007 428/394 |
| 2010/0187112 | A1* | 7/2010 | Han | B01L 3/50273 204/452 |
| 2010/0248388 | A1 | 9/2010 | Liu et al. | |
| 2011/0028719 | A1 | 2/2011 | Slon-Usakiewicz | |
| 2012/0028342 | A1* | 2/2012 | Ismagilov | B01L 3/502738 435/283.1 |
| 2012/0261567 | A1 | 10/2012 | Voorhees et al. | |
| 2013/0115634 | A1 | 5/2013 | Mehra et al. | |
| 2013/0183665 | A1 | 7/2013 | Chan et al. | |
| 2014/0073043 | A1 | 3/2014 | Holmes | |

OTHER PUBLICATIONS

Arndt et al., "Differential Carbohydrate Binding and Cell Surface Glycosylation of Human Cancer Cell Lines," Journal of Cellular Biochemistry, 2011, vol. 112, pp. 2230-2240.
Barrere et al., "Successful MALDI-MS Analysis of Synthetic Polymers with Labile End-Groups: The Case of Nitroxide-Mediated Polymerization Using the MAMA-SC1 Alkoxyamine," Chem. Eur. J., 2012, vol. 18, pp. 7916-7924.
Bilek et al., "Free radical functionalization of surfaces to prevent adverse responses to biomedical devices," PNAS, Aug. 2011, vol. 108(35), pp. 14405-14410.
Birdsall et al., "Modeling of protein electrophoresis in silica colloidal crystals having brush layers of polyacrylamide," Electrophoresis, Mar. 2013, vol. 34(5), pp. 753-760.
Bode et al., "Post-Translational Modification of p53 in Tumorigenesis," Nature Reviews, Cancer, Oct. 2014, vol. 4, pp. 793-805.
Buch et al., "Field-effect flow control in a polydimethylsiloxane-based mircofluidic system," Electrophoresis, 2001, vol. 22, pp. 3902-3907.
Chen et al., "MALDI MS Analysis of Oligonucleotides: Desalting by Functional Magnetite Beads Using Mircowave-Assisted Extraction," Anal. Chem., 2007, vol. 79, pp. 8061-8066.
Chen et al., "Serum and Urine Metabolite Profiling Reveals Potential Biomarkers of Human Hepatocellular Carcinoma," Molecular & Cellular Proteomics, 2011, 10:10.1074/mcp.M110.004945, 1-13.
Choi et al., "Diagnostic value of AFP-L3 and PIVKA-II in hepatocellular carcinoma according to total-AFP," World Journal of Gastroenterology, Jan. 2003, vol. 19(3), pp. 339-346.
Christiansen et al., "Cell surface protein glycosylation in cancer," Proteomics, 2014, vol. 14, pp. 525-546.
Ciftci et al., "Photoinitiated ATRP in Inverse Microemulsion," Macromolecules, 2013, vol. 46, pp. 9537-9543.
Cohen et al., "Small molecule analysis by MALDI mass spectrometry," Anal. Bioanal. Chem., 2002, vol. 373, pp. 571-586.
Cui et al., "Differential expression of the α2,3-sialic acid residues in breast cancer is associated with metastatic potential," Oncology Reports, 2011, vol. 25, pp. 1365-1371.
Dall'Olio et al., "Mechanisms of cancer-associated glycosylation changes," Frontiers in Bioscience, Jan. 2012, vol. 17, pp. 670-699.
Dennis et al., "Glycoprotein glycosylation and cancer progression," Biochimica. et Biophysica Acta, 1999, vol. 1473, pp. 21-34.
Drake et al., "Sweetening the Pot: Adding Glycosylation to the Biomarker Discovery Equation," Clinical Chemistry, 2010, vol. 56(2), pp. 223-236.
Dube et al., "Glycans in Cancer and Inflammation—Potential for Therapeutics and Diagnostics," Nature Reviews, Drug Discovery, Jun. 2005, vol. 4, pp. 477-488.
Ferreira et al., "Sialic acid differential expression in non-melanoma skin biopsies," Med. Mol. Morphol., 2013, vol. 46, pp. 198-202.
Fuster et al., "The Sweet and Sour of Cancer: Glycans as Novel Therapeutic Targets," Nature Reviews, Cancer, Jul. 2005, vol. 5, pp. 526-542.
Harvey et al., "Perspectives in the glycosciences—matrix-assisted laser desorption/ionization (MALDI) mass spectrometry of carbohydrates," Glycoconjugate Journal, 1998, vol. 15, pp. 333-338.
Heyries et al., "Straightforward Protein Immobilization Using Redox-Initiated Poly(methl methacrylate) Polymerization," Langmuir, 2009, vol. 25, pp. 661-664.
Hillenkamp, "Matrix-Assisted Laser Desorption/Ionisation Mass Spectrometry (MALDI-MS) the State of the Art," Advances in Mass Spectrometry, Aug. 29-Sep. 2, 1994, vol. 13, pp. 95-114.
Hillenkamp et al., "Matrix-Assisted Laser Desorption/Ionization Mass Spectrometry of Biopolymers," Analytical Chemistry, Dec. 1991, vol. 63(24), pp. 1193A-1201A.
Hosein et al., "Convectively assembled nonspherical mushroom cap-based colloidal crystals," Langmuir, Aug. 2007, vol. 23, pp. 8810-8814.
Hua et al., "Field-free remobilization of proteins after isoelectric focusing in packed capillaries," Anal. Chem., Nov. 2010, vol. 82(21), pp. 8910-8915 doi:10.1021/ac101680z.
Huges et al., "Single-cell western blotting," Nature Methods, Published online Jun. 2014, vol. 11, pp. 749-755, DOI: 10.1038/nmeth.2992.
Hutchens et al., "New Desorption Strategies for the Mass Spectrometric Analysis of Macromolecules," Rapid Communications in Mass Spectrometry, 1993, vol. 7, pp. 576-580.
Issaq et al., "SELDI-TOF MS for Diagnostic Proteomics," Analytical Chemistry, Apr. 2003, pp. 149 A-155 A.
Kang et al., "Protein and lipid MALDI profiles classify breast cancers according to the intrinsic subtype," BMC Cancer, 2011, vol. 11, pp. 465.
Karas et al., "Laser Desorption Ionization of Proteins with Molecular Masses Exceeding 10 000 Daltons," Anal. Chem., 1988, vol. 60, pp. 2299-2301.
Karas et al., "Matrix-assisted laser desorption ionization mass spectrometry," Mass Spectrometry Reviews, 1991, vol. 10, pp. 335-357.
Karas et al., "Matrix-Assisted Ultraviolet Laser Desorption of Non-Volatile Compounds," International Journal of Mass Spectrometry and Ion Processes, 1987, vol. 78, pp. 53-68.
Khadir et al., "Proteomics Approaches towards Early Detection and Diagnosis of Cancer," J. Carcinogene Mutagene, 2013, S14:002.
Kovtoun et al., "Mass Correlated Acceleration in a Reflectron MALDI TOF Mass Spectrometer: An Approach for Enhanced Resolution Over a Broad Mass Range," J Am Soc Mass Spectrom, 2002, vol. 13, pp. 135-143.
Lee et al., "A solid-phase bioreactor with continuous sample deposition for matrix-assisted laser desorption/ionization time-of-flight mass spectrometry," Rapid Commun. Mass Spectrom., 2011, vol. 25, pp. 693-699.
Leeming et al., "Post-translational modifications of the extracellular matrix are key events in cancer progression: Opportunities for biochemical marker development," Biomarkers, 2011, vol. 16(3), pp. 193-205.
Li et al., AFP-L3: a new generation of tumor marker for hepatocellular carcinoma, Clinica Chimica Acta, 2001, vol. 313, pp. 15-19.
Liang et al., "216-MALDI-MS detection and identification of bacterial toxins captured by cell-surface receptors on a stable yet fluid lipid bilayer," abstract only, http://acselb-529643017.us-west2.elb.amazonaws.com/chem/243nm/pro . . . , retrieved Jun. 29, 2015.
Loboda et al., "Investigation of the mechanism of matrix adduct formation in MALDI at elevated pressure," International Journal of Mass Spectrometry, 2005, vol. 240, pp. 101-105.

(56) References Cited

OTHER PUBLICATIONS

Ludwig et al., "Biomarkers in Cancer Staging, Prognosis and Treatment Selection," Nature Reviews/Cancer, Nov. 2005, vol. 5, pp. 845-856.
Malkin et al. "Sub-Micron Plate Heights for Capillaries Packed with Silica Colloidal Crystals," Anal. Chem., Mar. 2010, vol. 82(6), pp. 2175-2177.
Manna et al., "High-Throughput Quantification of Bioactive Lipids by MALDI Mass Spectrometry: Application to Prostaglandins," Anal., Chem., Sep. 2011, vol. 83(17), pp. 6683-6688.
Meng et al., "A novel controlled grafting chemistry fully regulated by light for membrane surface hydrophilization and functionalization," Journal of Membrane Science, 2014, vol. 455, pp. 405-414.
Miliotis et al., "Capillary liquid chromatography interfaced to matrix-assisted laser desorption/ionization time-of-flight mass spectrometry using an on-line coupled piezoelectric flow-through microdispenser," Journal of Mass Spectrometry, 2000, vol. 35, pp. 369-377.
Musyimi et al., "Direct coupling of polymer-based microchip electrophoresis to online MALDI-MS using a rotating ball inlet," Electrophoresis, 2005, vol. 26, pp. 4703-4710.
Njoya et al., "Silica Colloidal Crystals as Emerging Materials for High-Throughput Protein Electrophoresis," The AAPS Journal, Oct. 2013, vol. 15(4), pp. 962-969.
Rho et al., "Discovery of sialyl Lewis A and Lewis X modified protein cancer biomarkers using high density antibody arrays," J. Proteomics, Jan. 2014, vol. 96, pp. 291-299.
Salami et al., "Combining Urinary Detection of TMPRSS2:ERG and PCA3 with Serum Psa to Predict Diagnosis of Prostate Cancer," Urol. Oncol., Jul. 2013, vol. 31(5), pp. 566-571.
Sarrats et al., "Differential Percentage of Serum Prostate-Specific Antigen Subforms Suggests a New Way to Improve Prostate Cancer Diagnosis," The Prostate, 2010, vol. 70, pp. 1-9.
Satterfield et al., "Comparison by LC-MS and MALDI-MS of prostate-specific antigen from five commercial sources with certified reference material 613," Clinical Biochemistry, 2005, vol. 38, pp. 166-174.
Schmid et al., "Alpha-synuclein Post-translational Modifications as Potential Biomarkers for Parkinson Disease and Other Synucleinopathies," Molecular & Cellular Proteomics, 2013, 12: 10.1074/mcp.R113.032730, 3543-3558.
Siegel et al., "Matrix-Assisted UV-Laser Desorption/Ionization Mass Spectrometric Analysis of Monoclonal Antibodies for the Determination of Carbohydrate, Conjugated Chelator, and Conjugated Drug Content," Anal. Chem., 1991, vol. 63, pp. 2470-2481.
Sinakos et al., "Many Patients With Primary Sclerosing Cholangitis and Increased Serum Levels of Carbohydrate Antigen 19-9 Do Not Have Cholangiocarcinoma," Clinical Gastroenterology and Hepatology, 2011, vol. 9, pp. 434-439.
Tasdelen et al., "Studies on Photoinduced ATRP in the Presence of Photoinitiator," Macromolecular Chemistry and Physics, 2011, vol. 212, pp. 2036-2042.
van Kampen et al., "Biomedical Application of MALDI Mass Spectrometry for Small-Molecule Analysis," Mass Spectrometry Reviews, 2011, vol. 30, pp. 101-120.
von Eggeling et al., "Mass spectrometry meets chip technology: A new proteomic tool in cancer research?" Electrophoresis, 2001, vol. 22, pp. 2898-2902.
Wei et al., "Plate heights below 50 nm for protein electrochromatography using silica colloidal crystals," Anal. Chem., Dec. 2010, vol. 82(24), pp. 10216-10221.
Yang et al., "Direct detection of peptides and proteins on a microfluidic platform with MALDI mass spectrometry," Anal. Bioanal. Chem., 2012, vol. 404, pp. 1681-1689.
Yeo et al., "Microfluidic Devices for Bioapplications," Small, 2011, vol. 7(1), pp. 12-48.
Zaia, "Mass Spectrometry and Glycomics," OMICS A Journal of Integrative Biology, 2010, vol. 14(4), pp. 401-418.
Zhang et al., "Polyacrylamide brush layer for hydrophilic interaction liquid chromatography of intact glycoproteins," Journal of Chromatography a, 2013, vol. 1301, pp. 156-161.
Zhang et al., "Protein UTLC-MALDI-MS using thin films of submicrometer silica particles," Journal of Chromatography A, 2011, vol. 1218, pp. 7196-7202.
Zheng et al., "Silica Colloidal Crystals for Enhanced Fluorescence Detection in Microarrays," Anal. Chem., 2007, vol. 79, pp. 3867-3872.
Zhou et al., "Fabrication of Chemically Tethered Binary Polymer-Brush Pattern through Two-Step Surface-Initiated Atomic-Transfer Radical Polymerization," Macromolecular Rapid Communication, 2004, vol. 25, pp. 1979-1983.
International Search Report and Written Opinion, Jun. 29, 2015, PCT application No. PCT/US/22565, 8 pages.
Invitation to Pay Additional Fees (with partial search), May 20, 2015, PCT application No. PCT/US15/22395, 2 pages.
International Search Report and Written Opinion, Jul. 28, 2015, PCT Application No. PCT/US15/22395, 11 pages.

* cited by examiner

STEP 1: SAMPLE LOADING

STEP 2: ELECTROPHORESIS (SEPARATION)

STEP 3: IMMOBILIZATION (e.g., pH OR UV-LIGHT)

STEP 4: MATRIX APPLICATION

STEP 5: DETECTION

LASER DESORPTION IONIZATION MASS SPECTROMETRY USING A PARTICULATE SEPARATION BED

CROSS-REFERENCES TO RELATED APPLICATIONS

This application claims the benefit of U.S. Provisional Application No. 61/970,857, filed Mar. 26, 2014 and U.S. Provisional Application No. 61/970,818, filed Mar. 26, 2014, the disclosures of which are incorporated by reference in their entireties for all purposes.

STATEMENT AS TO RIGHTS TO INVENTIONS MADE UNDER FEDERALLY SPONSORED RESEARCH AND DEVELOPMENT

This invention was made with government support under CA161772 awarded by the National Institutes of Health. The government has certain rights in the invention.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Art

Generally, this application relates to molecular biology and microbiology chemistry processes and apparatuses including optical measuring or testing means. Certain embodiments relate to devices, systems, and methods for performing separations in an engineered material followed by matrix-assisted laser desorption/ionization (MALDI) in the same engineered material.

2. Background

There is a demand for miniaturization of traditional laboratory methods for analysis of biomolecules such as proteins and peptides. Advantages of miniaturization include smaller sample size, increased speed, and higher throughput. Currently, sodium dodecylsulfate-polyacrylamide gel electrophoresis (SDS-PAGE) remains a ubiquitous sieving medium for protein separation and a foundational component of numerous commercially available analytical systems. Capillary electrophoresis (CE) has miniaturized the cross-sectional dimensions of SDS-PAGE but still requires long lengths to enable good separation resolution. Certain CE-based methods have enabled automation and accurate, repeatable quantification, but exhibit limited dynamic range and require a number of complex, time-consuming steps (see, e.g., O'Neill, et al. *PNAS*. 2006, 103: 16153-16158). Certain microfluidic-based methods have increased binding efficiency and reduced complexity, but these methods are also characterized by reduced separation resolution (see, e.g., Hughes, et al. *PNAS*. 2012, 109: 21450-21455).

Mass spectrometry (MS) techniques are commonly used for identification and quantification of proteins and peptides, as well as for analysis of post-translational modifications. MS is also used for analysis of other classes of biomolecules. Two of the most common ionization modes used in proteomics are electrospray ionization (ESI) and matrix-assisted laser desorption ionization (MALDI). For human cancer detection, including biomarker discovery and protein pattern signature identification, MALDI-MS is extensively used because of its high throughput and versatility. MALDI-MS has been successfully used for the analysis of many sample types including: fragile biomolecules, lipids, biopolymers, carbohydrates, and glycoconjugates. As a soft ionization technique (i.e., providing analyte ions with minimal fragmentation), MALDI-MS can be used for analysis of intact biomolecules and simple mixtures over a relatively broad mass range. MALDI-MS generally includes the use of specialized matrices, such as sinapinic acid, that promote ion formation. The matrix, however, also generates adducts (i.e., chemical addition product-caused artifacts) that can mask results, reduce mass accuracies, and preclude the analysis of analytes with low molecular weights. Co-crystallization of matrix and sample can also be problematic as heterogeneous co-crystallization or variations in crystal sizes can result in poor shot-to-shot reproducibility and reduced mass accuracy. The use of MALDI-MS in the field of glycomics, for example, is often hindered by poorly resolved peaks among differentially modified proteins, limitations in the ability to analyze small carbohydrates, and the appearance of matrix adducts that can mask results.

In view of the foregoing, what is needed in the art are new systems and methods for separating and analyzing mixtures of biological molecules.

BRIEF SUMMARY

Generally, analytes in a sample are separated in an engineered material of nanoscale-sized silica particles using a voltage (e.g., electrophoresis, isoelectric focusing, chromatography). After the analytes are separated from one another, and without removing the separated analytes from the engineered material, at least one of the separated analytes is subject to matrix-assisted laser desorption ionization (MALDI).

The engineered material, dubbed a "silica colloidal crystal," includes microscopic (e.g., 300 nm diameter) spheres of silica (or other suitable material) that are of a regular size. The spheres self assemble into a highly-ordered monolithic "crystal" when subject to a drawdown coater, packed together in a slurry, or otherwise left to assemble.

The size of the spheres, including their mean or median diameters, manufacturing variation in diameter, or intentional "doping" with different-sized spheres, can be selected for optimal interstitial spacings. The spheres can be coated with a polymer or other substance during or after self assembly to partially fill the interstitial spaces between the particles. Further, the spheres can be coated before assembly with a compressible coating that 'gives' when the spheres are packed together, partially filling the interstitial spaces.

The silica colloidal crystal can contain additives to enhance its effectiveness in separating analytes, acting as a MALDI target, or both. For example, the spheres can be coated, pre- or post-assembly into a silica colloidal crystal, with a coating that binds with an analyte to immobilize it when illuminated with a laser beam. In another example, the coating is acidic in order to aide ionization by acting as source of protons and/or incorporates cinnamic acid in order to efficiently absorb laser energy.

Some embodiments of the present invention are related to a mass spectrometry method. The method includes:

introducing a sample into interstitial spaces between a plurality of silica particles, said plurality of silica particles extending in a longitudinal direction;

applying a voltage along said longitudinal direction to resolve one or more analytes from said sample;

irradiating a first analyte from said resolved one or more analytes in said interstitial spaces between said silica particles under conditions sufficient to produce analyte ions;

separating a first analyte ion from said analyte ions using a mass analyzer; and detecting said first analyte ion using a detector.

In some embodiments, the method includes:

introducing a sample into interstitial spaces between a plurality of silica particles, said silica particles having a coating comprising a plurality of capture moieties, under conditions sufficient for said capture moieties to bind to one or more analytes from said sample;

removing at least a portion of said sample from said interstitial spaces between said silica particles;

irradiating a first analyte from said one or more analytes bound to said capture moieties under conditions sufficient to produce analyte ions;

separating a first analyte ion from said analyte ions using a mass analyzer; and detecting said first analyte ion using a detector.

The method, devices, systems and other aspects, objects and advantages will become more apparent when read with the detailed description and figures which follow.

DETAILED DESCRIPTION

I. Definitions

Figure 1B:
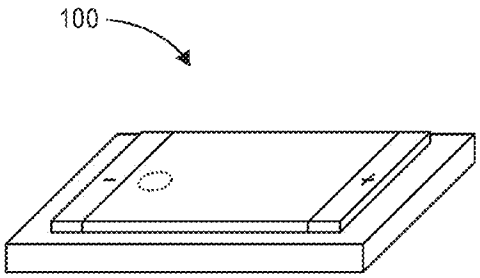
FIG. 1B illustrates a perspective view of the device of FIG. 1A.

As used herein, certain terms may have the following defined meanings. As used in the specification and claims, the singular form "a," "an" and "the" include singular and plural references unless the context clearly dictates otherwise. For example, the term "a cell" includes a single cell as well as a plurality of cells, including mixtures thereof.

The term "about," as used to modify a numerical value, indicates a defined range around that value. If "X" were the value, "about X" would generally indicate a value from 0.95X to 1.05X. Any reference to "about X" specifically indicates at least the values X, 0.95X, 0.96X, 0.97X, 0.98X, 0.99X, 1.01X, 1.02X, 1.03X, 1.04X, and 1.05X. Thus, "about X" is intended to teach and provide written description support for a claim limitation of, e.g., "0.98X." When the quantity "X" only includes whole-integer values (e.g., "X carbons"), "about X" indicates from (X−1) to (X+1). In this case, "about X" as used herein specifically indicates at least the values X, X−1, and X+1.

A "silica colloidal crystal" refers to a plurality of silica particles packed in a repeating pattern in two or three dimensions, or as otherwise known in the art. The crystal can be monocrystalline (containing a single unit cell having one periodic arrangement) or polycrystalline (including two or more unit cells having the same or different periodic arrangements, forming a plurality of crystal grains). The arrangement of the silica particles in the unit cell is analogous to the arrangement of atoms or molecules in a conventional crystal. The silica colloidal crystal contains space (i.e., interstitial space) between individual particles.

A "sample" refers to any mixture or pure substance having at least one analyte, or as otherwise known in the art.

An "analyte" includes a substance of interest such as a biomolecule. Biomolecules are molecules of a type typically found in a biological system, whether such molecule is naturally occurring or the result of some external disturbance of the system (e.g., a disease, poisoning, genetic manipulation, etc.), as well as synthetic analogs and derivatives thereof. Non-limiting examples of biomolecules include amino acids (naturally occurring or synthetic), peptides, polypeptides, glycosylated and unglycosylated proteins (e.g., polyclonal and monoclonal antibodies, receptors, interferons, enzymes, etc.), nucleosides, nucleotides, oligonucleotides (e.g., DNA, RNA, PNA oligos), polynucleotides (e.g., DNA, cDNA, RNA, etc.), carbohydrates, hormones, haptens, steroids, toxins, etc. Biomolecules can be isolated from natural sources, or they can be synthetic.

"Introducing" a sample into a separation bed can refer to filling (or partially filling) the interstitial spaces between particles of the separation bed with the sample, or as otherwise known in the art. Introducing the sample can include injection of the sample via pressure, gravity, or electrostatic force.

"Resolving" an analyte can refer to separating (or substantially separating) an analyte in a sample mixture from at least one other component of the sample. Analytes can be resolved according to a number of physical or chemical properties, including, but not limited to, the size of the analyte or the isoelectric point (pI) of the analyte. The pI of an analyte refers to the pH at which the analyte is a neutral species (i.e., has a net charge of about 0). Analytes can also be resolved using affinity-based separation techniques. Resolving and separating the analytes are used interchangeably. The separation bed is used to resolve or separate via for example, size or pI.

"Irradiating" an analyte can refer to subjecting an analyte to electromagnetic radiation. The radiation can be ultraviolet (UV) radiation, visible radiation, infrared (IR) radiation, or as otherwise known in the art. The radiation can originate from a laser, lamp, or other source and be directed or non-directed. "Under conditions sufficient to produce analyte ions" can include having a radiation intensity that ablates or ionizes a portion of the analyte, forming a plume, or as otherwise known in the art.

The term "matrix composition" refers to a mixture containing one or more matrix compounds, or as otherwise known in the art. Matrix compounds are typically organic molecules with molecular weights below 500 g/mole and absorption spectra overlapping the irradiation spectrum. Examples of matrix compounds include, but are not limited to, sinapinic acid and α-cyano-4-hydroxycinnamic acid. Matrix compositions can also include a solvent or mixtures of solvents, as well as acids for analyte protonation.

An "analyte ion" includes a gas-phase analyte molecule having a net negative or net positive charge, or as otherwise known in the art.

"Separating" an analyte includes isolating (or partially isolating) an analyte, in any phase, from a mixture of different substances, or as otherwise known in the art. An analyte can be resolved by using a separation bed. In some embodiments, there are two separation techniques being employed.

"Separating an analyte ion" includes isolating (or partially isolating) an analyte ion from a mixture of ions. Separating an analyte ion is typically conducted using a mass analyzer as a function of the molecular weight of the analyte ion. The mass analyzer can separate an analyte ion, for example, by deflecting the analyte ion in an electric or magnetic field, or by allowing the analyte ion to travel through a vacuum. Examples of mass analyzers include, but are not limited to, time-of-flight mass analyzers and quadrupole mass analyzers.

"Detecting" an analyte ion refers to measuring the abundance, charge, or other attribute of the analyte ion using a suitable detector.

The term "antibody," as used herein, can include antibody fragments either produced by the modification of whole antibodies or those synthesized de novo using recombinant DNA methodologies, or as otherwise known in the art. It also includes polyclonal antibodies, monoclonal antibodies, chimeric antibodies, and humanized antibodies.

A "primary antibody" will be understood by one of skill to refer to an antibody or fragment thereof that specifically binds to an analyte (e.g., substance, antigen, component) of interest. The primary antibody can further comprise a tag, e.g., for recognition by a secondary antibody or associated binding protein (e.g., GFP, biotin, or strepavidin).

A "secondary antibody" refers to an antibody that specifically binds to a primary antibody. A secondary antibody can be specific for the primary antibody (e.g., specific for primary antibodies derived from a particular species) or a tag on the primary antibody (e.g., GFP, biotin, or strepavidin). A secondary antibody can be bispecific, e.g., with one variable region specific for a primary antibody, and a second variable region specific for a bridge antigen.

A "biological marker" is a biomolecule, a biochemical label, or other biological label that identifies a structure or function of interest in a biological specimen/sample, or as otherwise known in the art.

II. Embodiments

Protein and DNA size-based separation techniques often rely on gels or polymer solutions to resolve populations of biomolecules. These gels and polymer solutions create a random sieving media through which the biomolecules migrate, separating the molecules by size as they pass through the media. The composition and porosity of conventional separation media can be modified to produce pores of different average sizes within the media. Though the average size of the pores can be controlled, the conventional separation media nevertheless contains a heterogeneous assortment of pore sizes that affect the overall separation efficiency. The heterogeneity of the pore sizes may be the main contributor to band broadening and negatively affects the resolution capability of the separation media.

The use of silica nanoparticles to form a colloidal crystal provides a new type of separation media which has a more monodisperse pore size, based on the monodispersity of the silica colloid size and the crystallization of the colloids. A monodisperse pore size greatly increases the separation efficiency, giving increased separation resolution when samples are separated over the same distance. An increase in the separation efficiency can lead to shorter separation lengths, increased resolution, or decreased separation times.

Embodiments of the present invention can provide for separating and detecting molecules such as biomolecules. In one embodiment, the invention provides a mass spectrometry method. The method includes:

- introducing a sample into interstitial spaces between a plurality of silica particles, said plurality of silica particles extending in a longitudinal direction;
- applying a voltage along said longitudinal direction to resolve one or more analytes from said sample;

irradiating a first analyte from said resolved one or more analytes in said interstitial spaces between said silica particles under conditions sufficient to produce analyte ions;

separating a first analyte ion from said analyte ions using a mass analyzer; and detecting said first analyte ion using a detector.

Figure 1A:
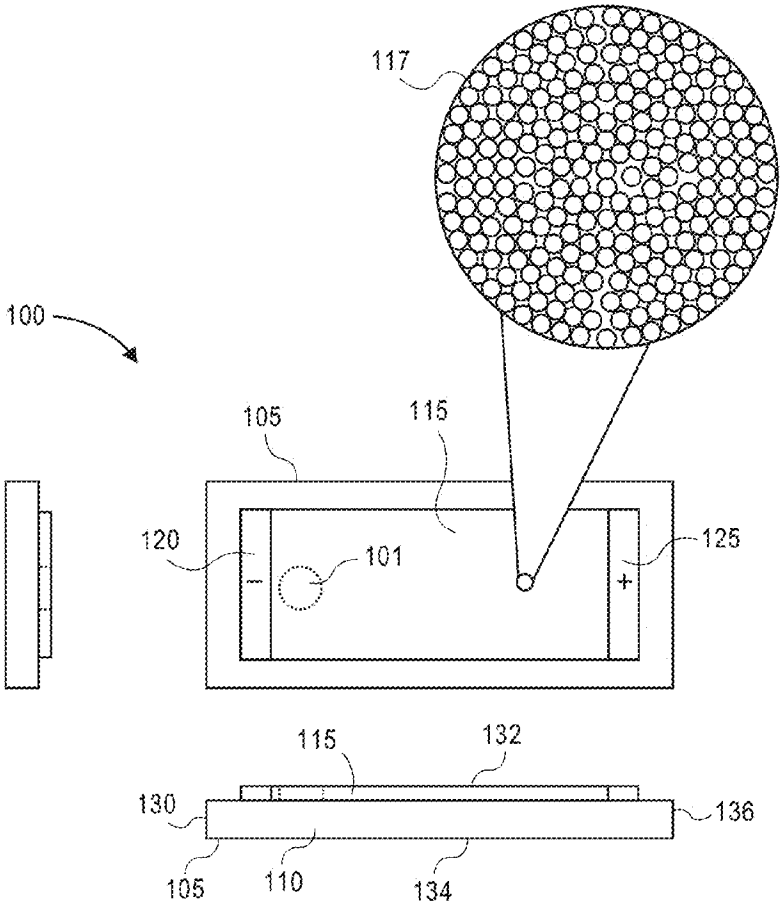
FIG. 1A illustrates a device with a silica colloidal crystal bed suitable for separation followed by MALDI in accordance with an embodiment.

FIGS. 1A-1B illustrate a device with a silica colloidal crystal bed suitable for mass spectrometry after electrophoresis.

In one aspect, a separation bed 115 having a plurality of particles 117 is disposed on a surface or substrate 110 of device 105. The substrate can be glass, plastic, metal, ceramic, or other inert surface material. The separation bed 115 may or may not be enclosed with other surfaces. For example, in some embodiments the separation bed is recessed in one or more troughs formed in the substrate.

In one aspect, a sample 101, which can be a mixture of proteins or biological molecules, is placed into the device and an electric field between voltage terminals 120 and 125 is applied. Terminal 120 typically has a negative voltage and terminal 125 is grounded. The device can then separate the mixture based on the charge of each of the molecules in the mixture. The separation bed can used to separate proteins as a function of size, pI, or other useful characteristic using electrophoresis, pressure-driven flow, convection, or other flow mechanism.

In certain aspects, embodiments include nanoparticles that are made of silica. In certain aspects, the silica nanoparticles are arranged in a regular, crystalline structure. In certain aspects, the crystal structure is body centered cubic. Each of the plurality of nanoparticles is between about 1 nm and about 2000 nm in diameter, more specifically between about 1 and 10, 20, 30, 40, 50, 60, 70, 80, 90, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or 2000 nm in diameter. The population of nanoparticles can be monodisperse or polydisperse. Larger particles, with diameters on the order of a few microns, can also be used. In certain aspects, the colloidal silica nanoparticles are spheres having a diameter of about 1 μm, thereby resulting in a minimum interstitial space size of about 155 nm and a surface-to-volume ratio of about 13.

In one aspect, the power for applying a voltage along the substrate between terminals 120 and 125 supplies an electric field having voltages of about 1 V $cm^{-1}$ to 2000 V $cm^{-1}$, such as 1, 10, 20, 30, 40, 50, 60, 70, 80, 90, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or 2000 V $cm^{-1}$. Higher voltages can also be used, depending on the particular separation method.

A technical advantage of using silica nanospheres as a separation medium is that higher voltages may be used than with SDS-PAGE gels, allowing faster separation of analytes. At high voltages, SDS-PAGE gels can break down and allow arcing. Silica nanoparticles can resist arcing.

In other aspects, an electrophoresis embodiment can be useful for performing a Western immunoassay. The system includes a means for applying a detection reagent. The means can include for example, a trough 130 or a chamber for contacting, dipping or incubating the separation bed or cassette of nanoparticles. In one aspect, the separation bed can be removed from the substrate and placed into or disposed into the means for applying a detection reagent. In other aspects, the trough is of a size that the substrate bed or array fits comfortably into for incubation. The detection reagent can be an antibody such as a primary or secondary antibody. In certain aspects, the means for applying a detection reagent to the substrate is a member selected from a trough, an incubator, a tub for contact, a vat, a chamber, a vessel, and the like. In one aspect, the means for applying the detection reagent is a spray nozzle or shower head above the separation bed.

Figure 2:
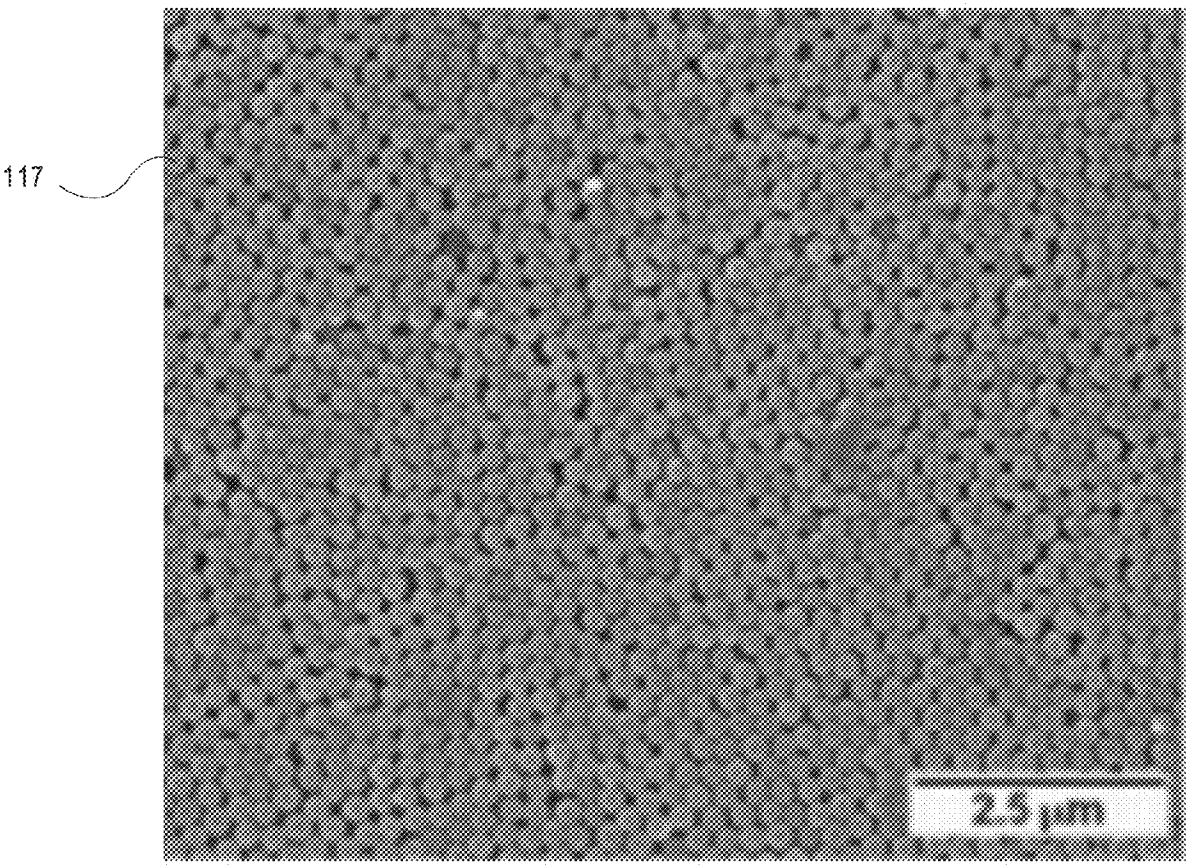
FIG. 2 is a scanning electron microscope (SEM) image of the surface of a silica colloidal crystal in accordance with an embodiment.

FIG. 2 is a scanning electron microscope (SEM) image of the surface of a silica colloidal crystal in accordance with an embodiment.

Silica nanoparticles having an approximate diameter of 250 nm, 500 nm, or 750 nm were purchased from Fiber Optic Center, Inc. (New Bedford, Mass.), and were then calcined at 600° C. for 12 hours. Glass or quartz microscope slides were purchased. The silica nanoparticles were deposited onto the glass microscope slides using a draw-down coater, forming a highly-ordered three-dimensional silica colloidal crystal. The nanoparticles were then coated with a brushed layer of polyacrylamide.

As evident from the image, the spherical silica nanoparticles self assemble into a largely regular structure. Some portions of the assembly are closely packed together, while others exhibit cracks and larger interstitial spaces.

The silica beads themselves have mostly the same diameters. Variance in the diameters is relatively low, such as less than ±25%, 20%, 15%, 10%, 9%, 8%, 7%, 6%, 5%, 4%, 3%, 2%, 1%, 0.5%, 0.25%, 0.1%, 0.01%, and other values.

Figure 3:
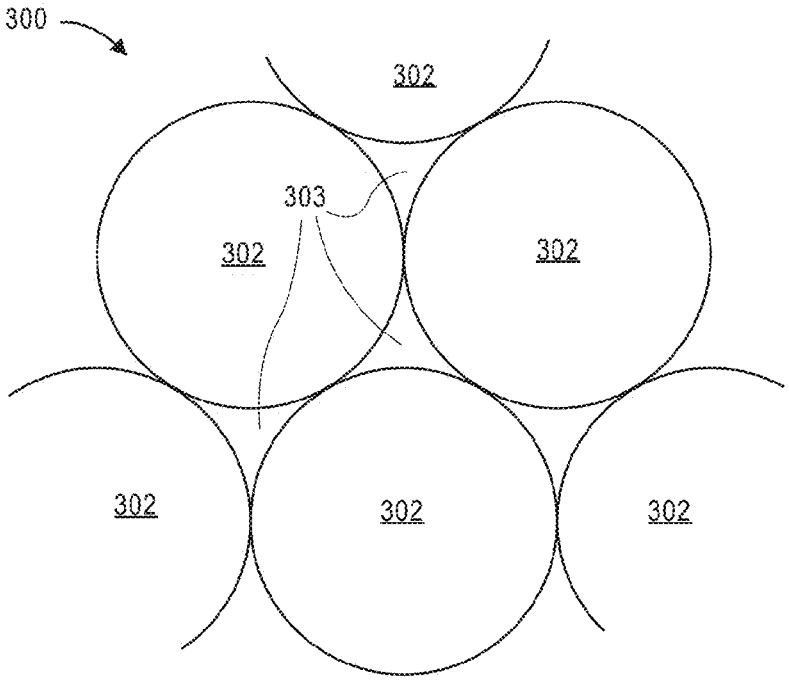
FIG. 3 illustrates a cross section of uncoated packed spherical nanoparticles in accordance with an embodiment.

FIG. 3 illustrates a cross section of bare, uncoated packed nanoparticle spheres in accordance with an embodiment. In engineered structure 300, silica spheres 302 mate closely with one another when packed, forming small interstitial voids 303 between them. The size of the voids, sometimes referred to as the pore size, can determine the absolute size of molecules that can funnel through the structure. Further, the size of the voids can determine the speed that certain molecules can squeeze through the structure.

Different packing configurations, such as body centered cubic (BCC), face centered cubic (FCC), hexagonal close packed, etc. can form in various parts of the silica colloidal crystal. Imperfections and voids can result in microcracks in some areas of the structure.

Figure 4:
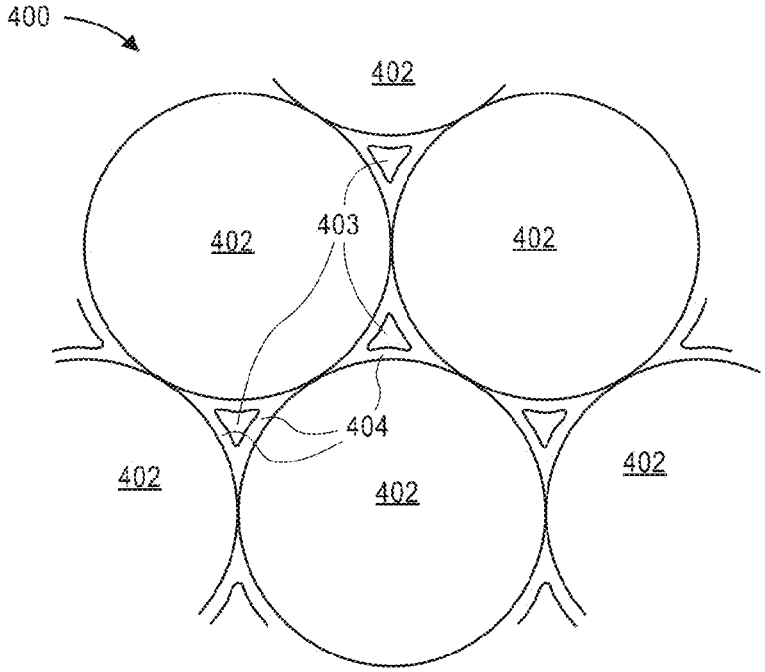
FIG. 4 illustrates a cross section of packed spherical nanoparticles with a post-packing coating in accordance with an embodiment.

FIG. 4 illustrates a cross section of packed silica nanoparticles with a post-packing coating in accordance with an embodiment. After packing nanoparticles 402 together, the resulting engineered structure 400 is brush coated with a thin polymer, such as polyacrylamide, that seeps into interstitial spaces 403. The thin liquid coats the spheres with film 404, filling in a portion of the interstitial spaces. This causes the interstitial spaces to be smaller than they once were.

The polymer may be activated in order to immobilize certain analytes. This activation can be triggered by using electromagnetic radiation, such as ultraviolet light, infrared light, or visible light.

Figure 5:
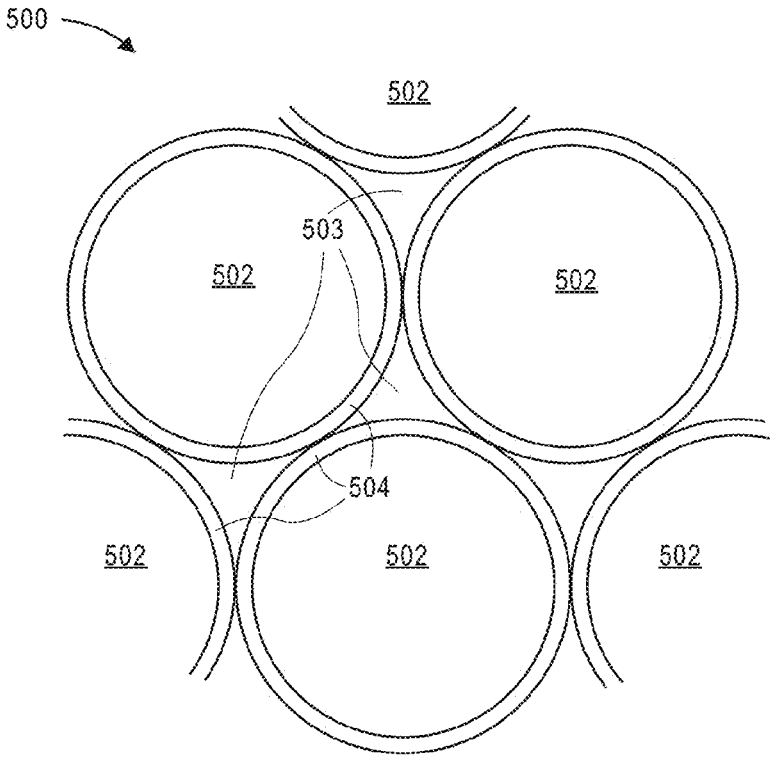
FIG. 5 illustrates a cross section of packed spherical nanoparticles with a hard pre-packing coating in accordance with an embodiment.

FIG. 5 illustrates a cross section of packed spheres with a hard pre-packing coating in accordance with an embodiment. Before the particles are packed together, they are coated with thin polyacrylamide layer that hardens into a relatively even incompressible shell 504. As shown, the particles are effectively a little larger in diameter than uncoated nanoparticles 502. The particles are then packed together into engineered structure 500 and self-assemble, leaving regular interstitial spaces 503.

Figure 6:
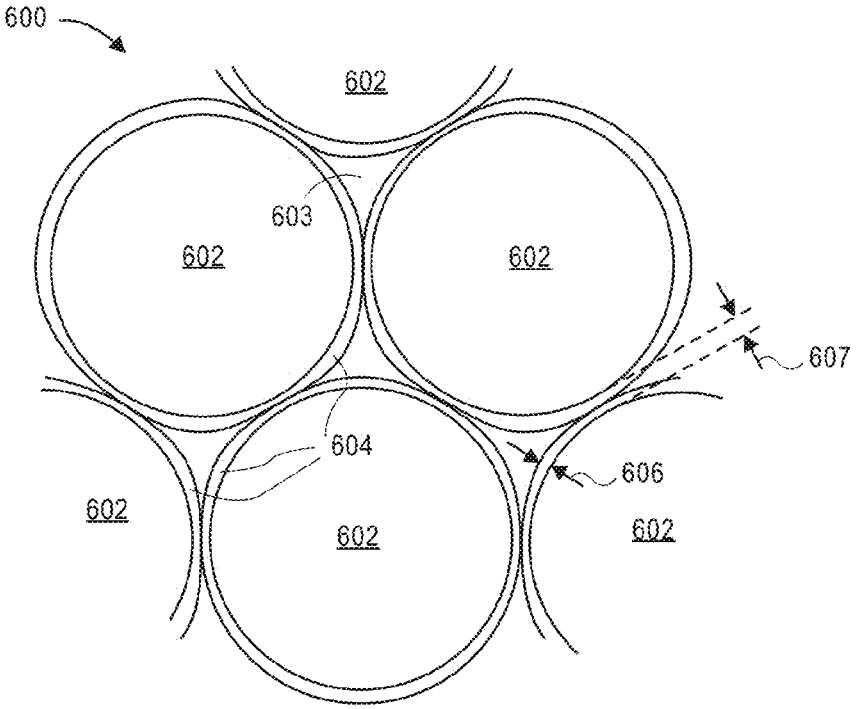
FIG. 6 illustrates a cross section of packed spherical nanoparticles with a compressible pre-packing coating in accordance with an embodiment.

FIG. 6 illustrates a cross section of packed spheres with a compressible pre-packing coating in accordance with an embodiment. Before nanoparticles 602 are packed together, they are coated with a thin layer that hardens into a relatively even shell 604. However, the shell is slightly resiliant. As shown, the shells compress when the particles are packed together into engineered structure 600, lessening the size interstitial spaces 603.

The shells have an uncompressed thickness 606. Thus, the distance between the silica core of the particles when the shells are uncompressed is 2 times thickness 606. However, the compression in packing the particles together results in a distance 607 between the silica core of the particles. Interstitial spaces are shrunk by the amount that the uncompressed portion of the shell intrudes as well as the Young's modulus deformation of resiliant material from directly between the particles laterally into the interstitial space. In other words, the shell material slightly squeezes into the interstitial space, lessening the pore size.

The compressibility of the shells can be used for fine tuning of pore sizes after the silica colloidal crystal structure is assembled. For example, the sides and top of the structure can be compressed with a mechanical or electrical actuator, causing the voids to shrink by a small amount. Likewise, stretching the structure from the sides can increase pore size.

Figure 7:
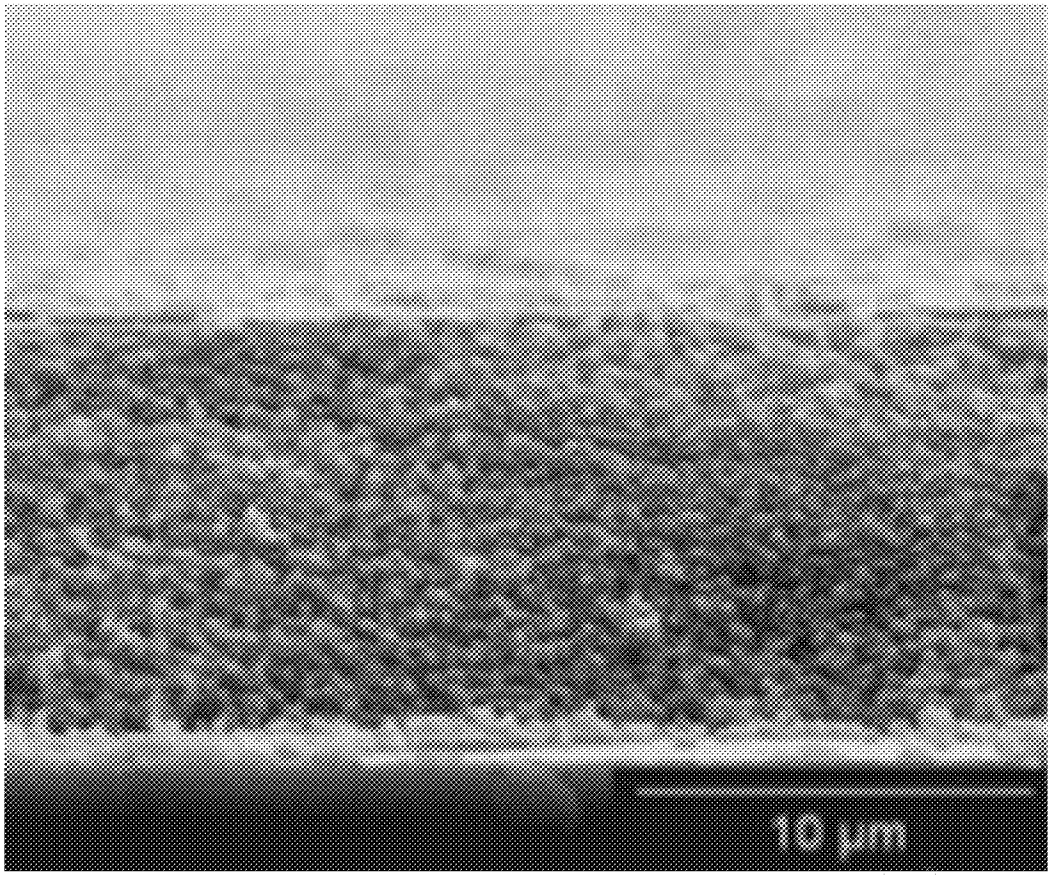
FIG. 7 is an image of a cross section of a silica colloidal crystal in accordance with an embodiment.

FIG. 7 is an image of a cross section of a silica colloidal crystal in accordance with an embodiment. The silica colloidal crystal is a thin film of about 10 μm in thickness. The cross section is not cleaved cleanly, thus, the spongy appearance in the image. There are few large features, such as macroscopic cracks or hollows, in the film.

Figure 8:
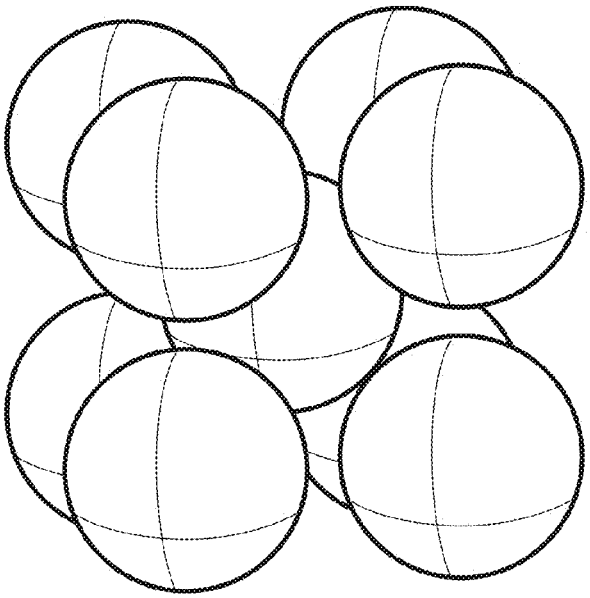
FIG. 8 illustrates spheres in a body centered cubic (BCC) configuration in accordance with an embodiment.
Figure 9:
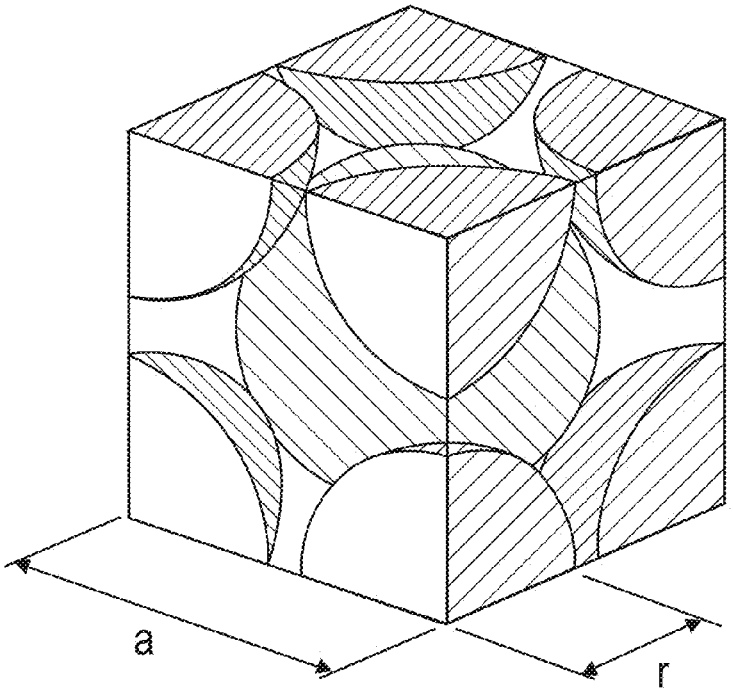
FIG. 9 illustrates one unit cell of spheres in a body centered cubic configuration in accordance with an embodiment.

FIGS. 8-9 illustrate ideal spheres in a body centered cubic (BCC) configuration. Despite cracks and imperfections in real-world engineered structures, it has been found that the spherical nanoparticles self assemble into quite regular structures, commonly a body centered cubic configuration. Thus, the body centered cubic configuration can be a good approximation for some portions of the resulting structure.

FIG. 9 illustrates one unit cell, which is useful for calculations. If each sphere has a radius 'r', then the length 'a' of each edge of the unit cell is:

$$a = \frac{4}{\sqrt{3}} r \qquad \text{Eqn. (1)}$$

The minimum pore size between the spheres is:

$$d_{pore,min} = \frac{4}{\sqrt{3}} r - 2r \qquad \text{Eqn. (2)}$$

The volume of interstitial space in each unit cell is:

$$V_{interstitial} = V_{unit\ cell} - V_{bead} = \left(\frac{4}{\sqrt{3}} r\right)^3 - 2 \cdot \frac{4}{3} \cdot \pi r^3 \qquad \text{Eqn. (3)}$$

Interestingly, the ratio of interstitial volume to unit cell is a constant 47.0% for all sizes of spherical particles.

The wettable surface area within each unit cell is:

$$2 \cdot 4\pi r^2 \qquad \text{Eqn. (4)}$$

A table of some of these values with respect to particle diameter is provided below.

TABLE 1

| Particle Diameter (nm) | Radius r (nm) | Unit Cell Edge Length a (nm) | Pore Size (nm) | # of particles in 1 $cm^3$ | Square meters of surface area in 1 $cm^3$ |
|---|---|---|---|---|---|
| 1 | 0.5 | 1.15 | 0.15 | $1.3 \times 10^{21}$ | 4,081 |
| 10 | 5.0 | 11.5 | 1.54 | $1.3 \times 10^{18}$ | 408 |
| 100 | 50 | 115 | 15.4 | $1.3 \times 10^{15}$ | 40.8 |
| 250 | 125 | 289 | 38.6 | $8 \times 10^{13}$ | 16.3 |
| 300 | 150 | 346 | 46.4 | $5 \times 10^{13}$ | 13.6 |
| 500 | 250 | 577 | 77.3 | $1 \times 10^{13}$ | 8.16 |
| 750 | 375 | 866 | 116 | $3 \times 10^{12}$ | 5.44 |
| 1000 | 500 | 1155 | 155 | $1.3 \times 10^{12}$ | 4.08 |
| 2000 | 1000 | 2309 | 309 | $1.6 \times 10^{11}$ | 2.04 |

Figure 10A:
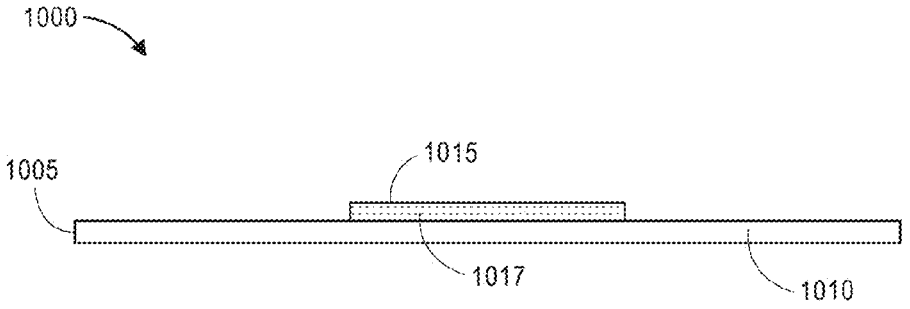
FIG. 10A illustrates a side view of a microscope slide separation bed device in accordance with an embodiment.
Figure 10B:
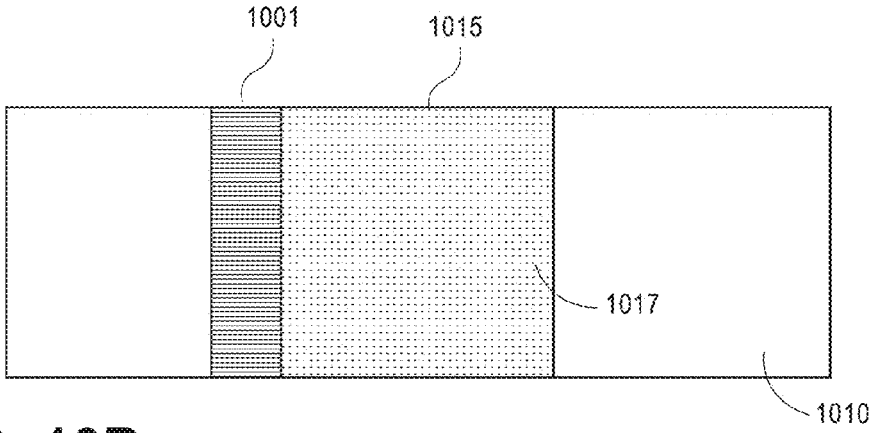
FIG. 10B illustrates a top view of the device of FIG. 10A with a sample loaded.
Figure 10C:
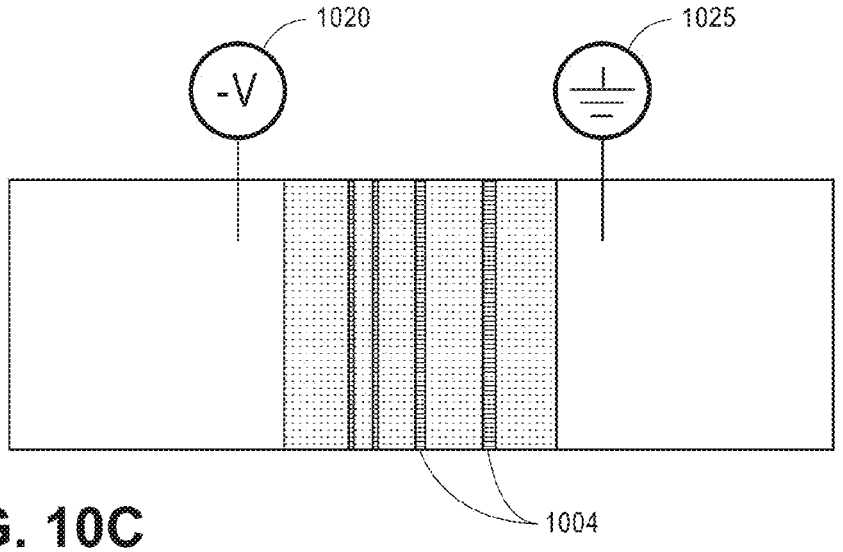
FIG. 10C illustrates a top view of the device of FIG. 10A with separated analytes.

FIGS. 10A-10C illustrate an electrophoresis embodiment.

FIG. 10A illustrates a side view of separation bed 1015 having a plurality of particles 1017 disposed on substrate 1010. Substrate 1010 is shown as a standard glass microscope slide; however, other configurations are contemplated.

FIG. 10B illustrates test sample 1001 introduced from one side of separation bed 1015. Separation bed 1015 has individual particles 1017 to effectuate separation of a mixture of analytes (e.g., a mixture of biomolecules).

FIG. 10C illustrates an electric field applied between voltage terminals 1020 and 1025 sufficient to resolve a plurality of analytes or mixture of molecules in the sample into bands 1004. Bands 1004 can optionally be removed from the separation bed (e.g., by eluting the sample) and further analysis can be performed. In one instance, the molecular weight of the analyte can be determined.

FIGS. 11A-11D illustrate an embodiment of the electrophoresis system configured for parallel analysis of multiple samples.

Figure 11A:
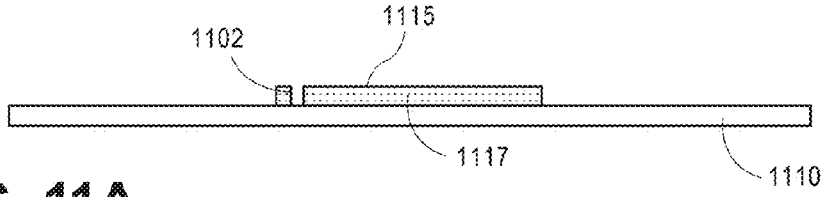
FIG. 11A illustrates a side view of a multi-lane microscope slide separation bed device in accordance with an embodiment

FIG. 11A illustrates a cut-away side view. It shows arrangement of well 1102 in separation bed 1115 having a plurality of particles 1117 disposed on substrate 1110.

Figure 11B:
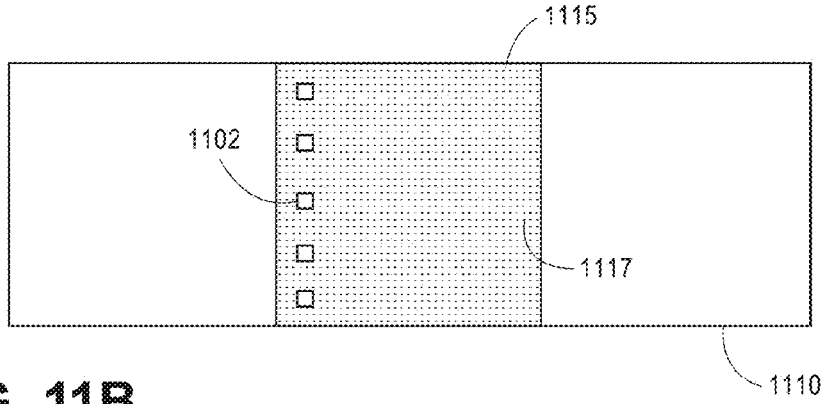
FIG. 11B illustrates a top view of the device of FIG. 11A.

FIG. 11B shows a top view of separation bed 1115 having the plurality of particles 1117 disposed on substrate 1110. The separation bed also contains a number of wells 1102.

Figure 11C:
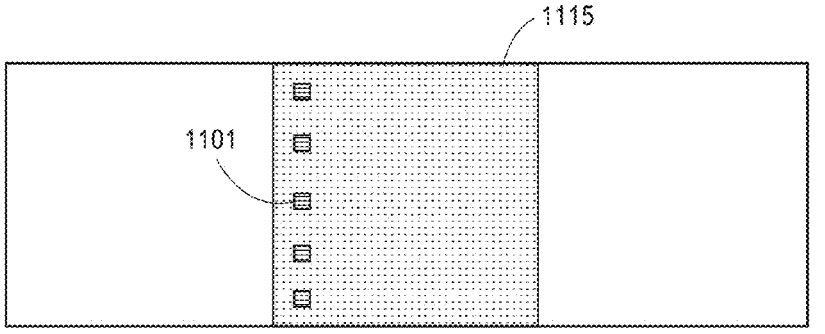
FIG. 11C illustrates a top view of the device of FIG. 11A with loaded samples.

FIG. 11C illustrates the individual wells of separation bed 1115 loaded with samples 1101 (now darkened). Any number of wells can be loaded with the same or different samples. One sample can include a control, molecular weight protein ladder, and the like. Since the plurality of wells contain little-to-no silica particles, the sample will generally remain confined within the well for some amount of time. Further, once the electric field is applied, the samples 'stack' on the leading edge of the separation bed to improve separation or resolution.

Figure 11D:
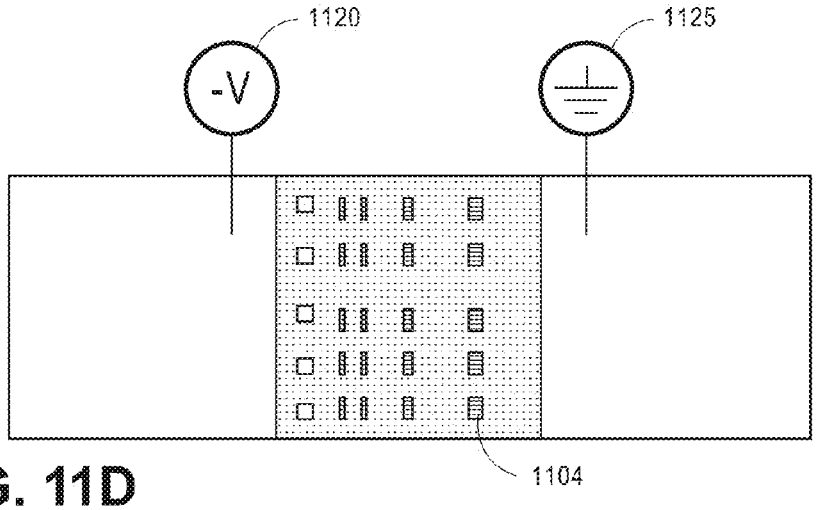
FIG. 11D illustrates a top view of the device of FIG. 11A with separated analytes.

FIG. 11D depicts the results of applying an electric field between voltage terminals 1120 and 1125 sufficient to resolve a plurality of analytes in the sample into individual bands 1104. In the case of the samples in the figure, the five wells contained the same sample with four different analytes. The analyte farthest right in the figure has the highest concentration in the mixture.

Other configurations can be used for parallel analysis of multiple samples, which may be the same or different. For example, the separation bed of silica particles can be divided into a number of lanes. A space between the lanes can be a solid (e.g., part of a removable lid) or the space can be empty (i.e., dry, gaseous).

The silica particles provide a strong capillary force. When a sample of a certain volume is pipetted onto an individual lane, the sample will likely remain within the lane. If for example, the separation method is isoelectric focusing (using pI), the samples do not have to be "stacked" at either end. As such, the lane configuration is convenient for keeping samples separate and in distinct areas from one another while allowing one-dimensional (1D) separation.

After separation, an analyte can be ionized and directed toward a mass spectrometer for analysis. The silica particles provide a tough, inert structure for immobilization of analytes.

Figure 12:
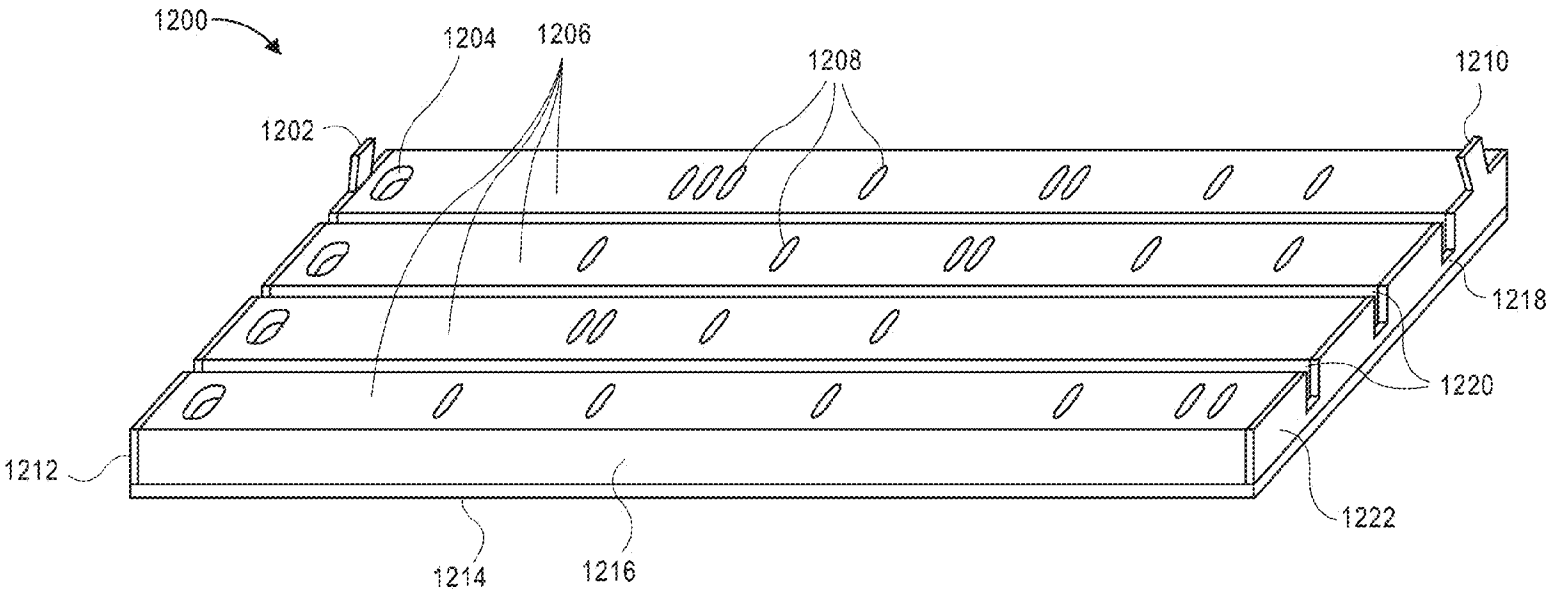
FIG. 12 illustrates a perspective view of a multi-lane integrated separation bed-MALDI target in accordance with an embodiment.

FIG. 12 is a perspective illustration of a multi-lane integrated separation medium-MALDI target apparatus in accordance with an embodiment. In apparatus 1200, hard, rigid substrate 1214 supports monolithic silica colloidal crystal 1216. Silica colloidal crystal 1216 has lanes 1206 for separation, each lane 1206 spaced apart by division notches 1220. In the exemplary embodiment, the notches do not extend all the way to substrate 1214. Thus, the silica colloidal crystal is deemed "monolithic." However, in some embodiments the notches may extend down to substrate 1214 to completely isolate the fluid path of each lane from one another. Within each lane 1206 is a pre-manufactured divot well for placing a sample. The divot holds the sample in place until voltage is applied.

On each end of apparatus 1200 are affixed metal foil plates 1212 and 1222. The plates are electrically isolated from each other, but each lane 1206 is connected at one end by metal connections 1218. Voltage is applied between plates 1212 and 1222 by applying a attaching metal tabs 1202 and 1210, by alligator clips or other connectors, to a power supply. The voltage causes analytes within the samples to migrate from their wells 1204 down their respective lanes 1206.

Analytes separate into spots 1208 within each lane 1216 of silica colloidal crystal 1216. This can be through electrophoresis, isoelectric focusing, chromatography, or other methods that use electrical voltage potentials to separate analytes.

After separation, each separated analyte 1208 can be targeted by a laser in order to ionize the analyte for use in a mass spectrometer. In some embodiments, matrix for MALDI can be added to wells 1204 with the sample. In other embodiments, matrix is dropped at the separate spot locations. In other embodiments, matrix is bound in the coating of the nanoparticles.

Figure 13:
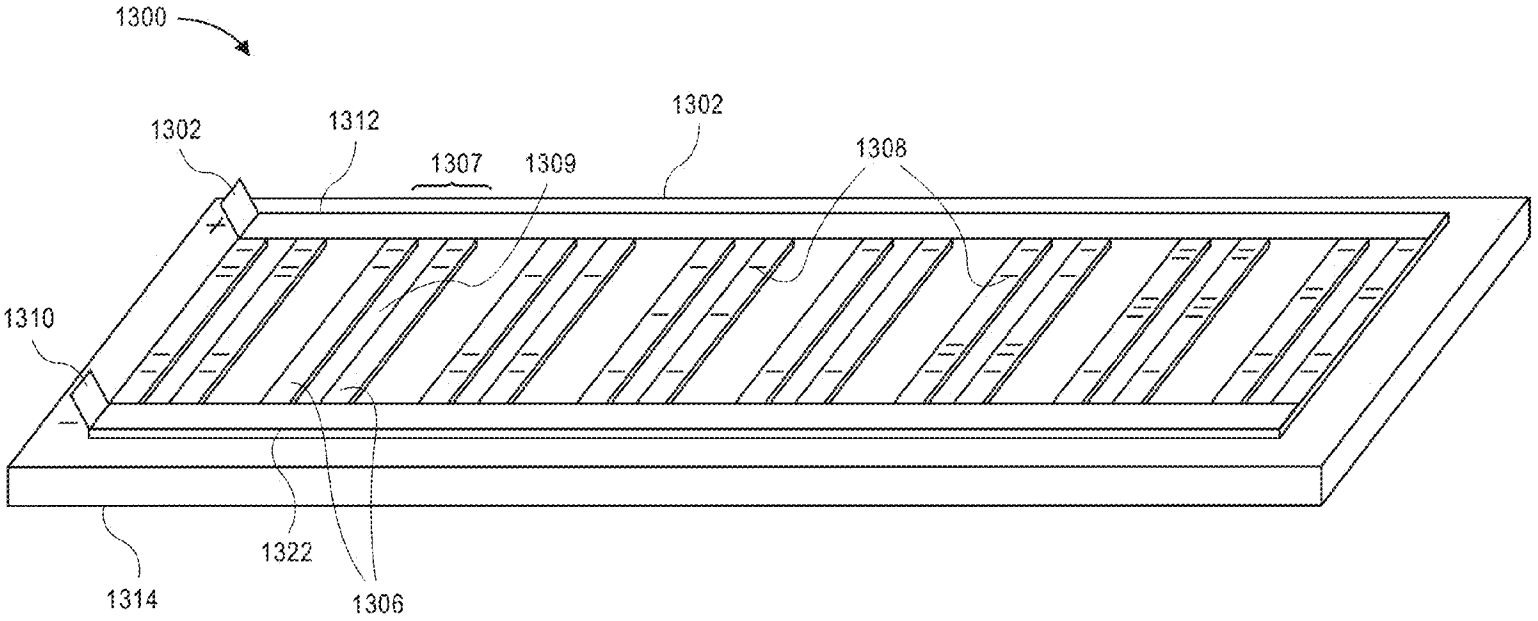
FIG. 13 illustrates a perspective view of a dual isoelectric focusing (IEF) Western+MALDI configuration in accordance with an embodiment.

FIG. 13 illustrates a configuration with dual lanes for isoelectric focusing and MALDI in accordance with an embodiment. In system 1300, substrate 1314 has eight lane pairs 1307 of lanes 1306. Each lane pair is separated by spacer 1309. In the exemplary embodiment, spacer 1309 is an air gap. In other embodiments, the spacer may be a solid fence material.

Electrically conductive path 1312 electrically connects together one edge of all sixteen lanes 1306, and electrically conductive path 1322 electrically connects together the opposite edge of the sixteen lanes 1306. When a voltage difference is applied between metal contacts 1302 and 1310, samples traverse longitudinally down each lane and separate into analytes 1308 depending upon their isoelectric point (pI). For example, conductive path 1302 can be an anode with $H_3PO_4$, and conductive path 1322 can be a cathode of NaOH.

One lane of each lane pair 1307 can be subject to ionization for MALDI analysis. The ionizing laser beam can destroy an analyte in that lane. However, the other, corresponding lane's analyte at the same longitudinal position is preserved and can be used for further analysis if the mass spectrometer turns up something interesting that needs further analysis.

Figure 14:
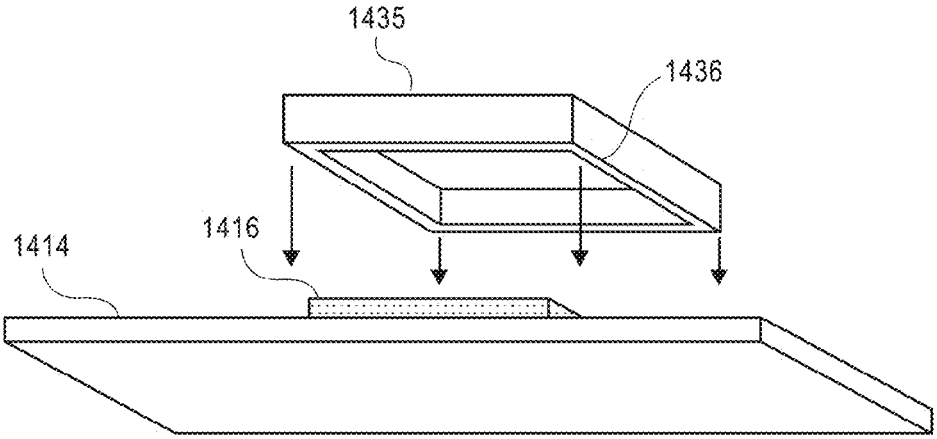
FIG. 14 illustrates a bottom perspective view of a cover for a separation bed in accordance with an embodiment.

FIG. 14 illustrates a cover that can be placed over a separation bed in accordance with an embodiment. Manifold 1435 with gasket 1436 is aligned with separation bed 1416 on substrate 1414 so as to form a chamber into which a detection reagent can be introduced. The chamber formed by the manifold can cover the entire area of the separation bed.

The cover is shown on the top, but the whole assembly can be inverted so that the cover is on the bottom.

Figure 15:
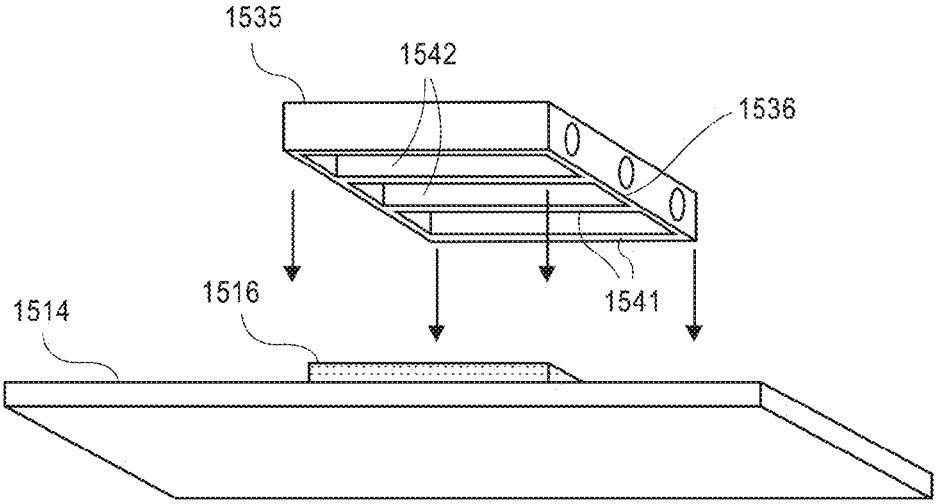
FIG. 15 illustrates a bottom perspective view of a cover for a multi-lane separation bed in accordance with an embodiment.

FIG. 15 illustrates a cover that can be placed over a separation bed in accordance with an embodiment. Manifold 1535 with gasket 1536 is aligned with separation bed 1516 on substrate 1514.

Manifold 1535 has built-in partitions 1541 that form several individual chambers 1542 into which the same or different detection reagents can be introduced independently. For example, the manifold can form a lane or chamber 1542 covering an area containing resolved analytes from an individual sample. Multiple lanes can be arranged adjacent to each other for parallel analysis of multiple samples.

After separation, the cover can be removed. Analytes can then be subject to MALDI analysis.

In one aspect, each of the nanoparticles is less than 2 μm (2000 nm) in diameter, and together they form a stationary phase for analytical separation. In some embodiments, the nanoparticles are each preferably nonporous. In certain instances, larger nanoparticle sizes can result in a decrease in the ratio of surface to volume and an increase in the pore radius. This can decrease the selectivity and increase the migration speed of the analyte. In contrast, the smaller the nanoparticle size, the surface area to volume ratio increases and the pore radius decreases. This typically results in better or increased selection.

In certain aspects, the population of nanoparticles are uncoated, coated, or a mixture of uncoated and coated. In certain aspects, protein-free blocking buffer is used with uncoated nanoparticles (e.g., Pierce 37584 Protein-Free (PBS) Blocking Buffer). In certain aspects, buffers that suppress or eliminate electroosmotic flow (EOF) are used with uncoated nanoparticles (e.g. formic acid containing buffers).

In certain aspects, the nanoparticles are coated, such as with a polymer coat. The polymer modification can be a hydrophobic or a hydrophilic polymer. The nanoparticles can have a mixture of different types of coatings. In certain aspects, each of the plurality of colloidal silica nanoparticles includes a polymeric particle coating.

Suitable hydrophilic polymers include, but are not limited to, polyalcohols, polyoxyethylenes, polyethers, polyamides, polyimides, polycarboxylates, polysulfates, polysufonates, polyphosphates, polyphosphonates and a combination thereof. In certain aspects, the polyamide hydrophilic polymer is a polyacrylamide. In certain aspects, the polymeric coating contains one or more benzophenone moieties.

In certain aspects, the polymer forms a brush layer on the plurality of nanoparticles. In one instance, the brush layer is a polyacrylamide. The bed of coated nanoparticles forms a matrix of silica particles ideal for separation.

In certain aspects, the hydrophilic polymer layer is further functionalized for immobilization of an analyte. In one aspect, the immobilization of the analyte is covalent. Alternatively, the immobilization is noncovalent. In certain aspects, the functionalization for immobilization of an analyte is effectuated by UV light, by a change in pH, or by precipitation. For example, proteins can be precipitated or fixed via an acid solution. Alternatively, proteins can be immobilized on separation bed via photoactivation of a benzophenone moiety which generates a highly reactive triplet intermediate to form a covalent bond. Further, a radical species can react with tyramide to amplify signals.

The silica particles can be modified using known techniques to incorporate a number of chemical functional groups that modify the surface properties of the crystal. A strong anion exchange group, such as a quaternary amine, can be used to immobilize proteins via electrostatic interaction with negatively-charged amino acid residues. A weak cation exchange group, such as a carboxylate, can be used to immobilize proteins via electrostatic interaction with positively-charged amino acid residues. A chelated metal, such as a nickel-NTA moiety, can be used to immobilize proteins with accessible histidine, tryptophan, and cysteine residues. Hydrophobic groups, including $C_8$-$C_{18}$ moieties, can be used to immobilize proteins via hydrophobic interactions. Such surfaces can be used for surface-enhanced laser desorption ionization (SELDI) mass spectrometry and related techniques (see, e.g., Hutchens et al. *Rapid Commun. Mass. Spec.* 1993, 7:576-580; Issaq, et al. *Anal. Chem.* 2003, 75: 149A-155A).

In general, the plurality of colloidal silica nanoparticles used in the methods of the invention extends in a first, longitudinal direction. A voltage is applied along the longitudinal direction to resolve one or more analytes from the sample that is introduced into the spaces between the nanoparticles. In certain aspects, the plurality of colloidal silica nanoparticles further extends in a second, latitudinal direction. The methods of the invention can further include resolving one or more analytes along the latitudinal direction. In certain aspects, the resolution or separation is performed using the size of the analyte. Separations in multiple dimensions are also possible.

In certain aspects, the electrophoresis systems and methods of the present invention resolve or separate the analyte as a function of the pI of the analyte. The isoelectric point (pI) is the pH at which a particular molecule carries no net electrical charge. Other suitable techniques for resolution or separation include, but are not limited to, electrophoresis, isoelectric focusing, ion exchange chromatography, cation exchange chromatography, and hydrophobic interaction chromatography. Resolution can also be conducted using affinity chromatography, wherein separation results from interaction of one or more analytes with binding moieties such as antibodies, lectins, and aptamers, in the separation bed.

Accordingly, some aspects of the invention provide mass spectrometry methods wherein the one or more analytes are resolved along the longitudinal direction according to the size of the analytes. In certain aspects, the one or more analytes are resolved along the longitudinal direction according to the isoelectric point of the analytes. In certain aspects, the resolution in the latitudinal direction is performed using a technique selected from the group consisting of electrophoresis, isoelectric focusing, and affinity chromatography.

FIGS. 16A-16E illustrates one embodiment 1600 of a mass spectrometry method. As shown therein, separation bed 1615 having a plurality of silica nanoparticles, such as a silica colloidal crystal 1617, is disposed on a surface or substrate 1610 of a device.

Figure 16A:
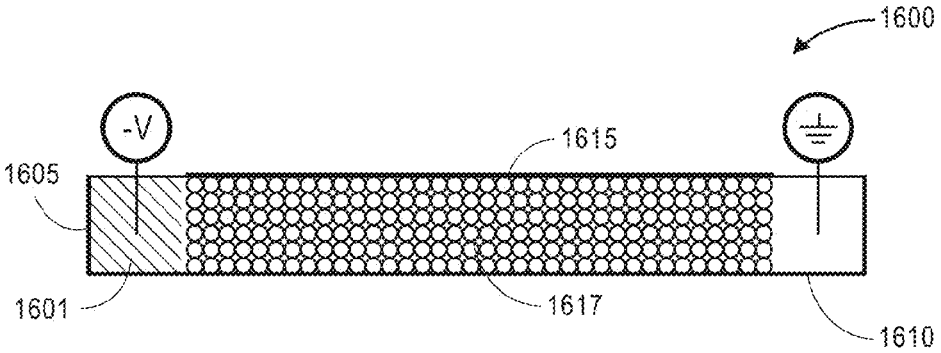
FIGS. 16A-16E illustrate an electrophoresis and MALDI method in accordance with an embodiment.

In FIG. 16A, sample 1601, which can be a mixture of proteins or biological molecules, is placed into the device and an electric field between terminals 1620 and 1625 is applied. In one instance, the mixture of analytes to be separated is placed at the cathode end. In another aspect, the mixture of analytes to be separated is placed at the anode end. In another aspect, the mixture of analytes to be separated is placed in between the anode and cathode ends.

Figure 16B:
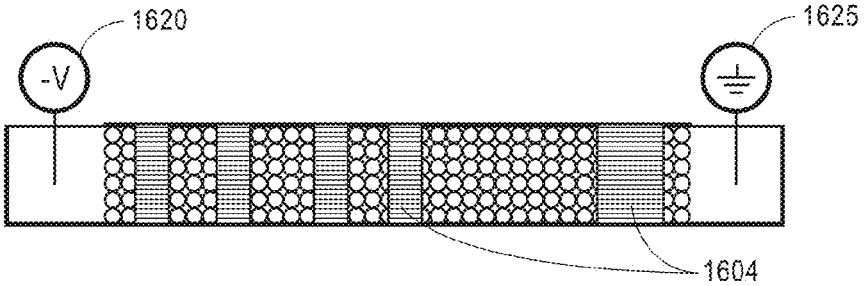

In FIG. 16B, a sample for analysis is loaded on the device and the power supply is used to electrophoretically separate the sample into analytes 1604. The separation bed is used to separate proteins as a function of size, pI, or other useful characteristics of the analyte using electrophoresis, pressure-driven flow, convection, or other flow mechanism. The electrophoresis system can then separate the mixture in a second dimension based on the charge and or size of each of the molecules in the mixture.

Figure 16C:
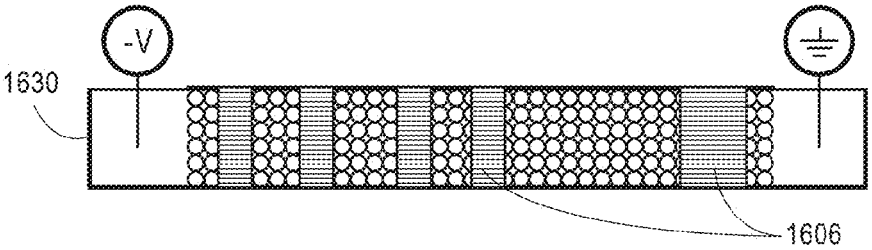

In FIG. 16C, after the mixture is separated (e.g., in 1 dimension, 2 dimensions, 3 dimensions), the analytes (such as proteins) are optionally immobilized 1630 on the nanoparticles using for example, pH, light, precipitation, or another immobilization technique, as described above, to form one or more immobilized analytes 1606.

In one aspect, the nanoparticles are coated with a non-specific protein immobilization moiety that is activated post-separation (e.g. UV-light), or electrolytes are introduced by electrophoresis or pressure to initiate a pH-dependent reaction, or the separation bed is submerged in an electrolyte.

Mass spectra of resolved analytes can be acquired according to techniques that are generally known to those of skill in the art. Typically, "soft" ionization sources such as laser desorption/ionization are used in the methods of the invention. Various types of mass analyzers can be interfaced with a laser desorption/ionization ion source. In certain aspects, the invention provides mass spectrometry methods as described above, wherein the mass analyzer is selected from a time-of-flight mass analyzer, a quadrupole mass analyzer, and a Fourier-transform ion cyclotron resonance mass analyzer. In certain preferred aspects, the mass analyzer is a time-of-flight mass analyzer. Mass spectra can be acquired using a mass spectrometer having a matrix-assisted laser desorption ionization (MALDI) ion source and a time-of-flight (TOF) mass analyzer (i.e., using MALDI-TOF MS).

Figure 16D:
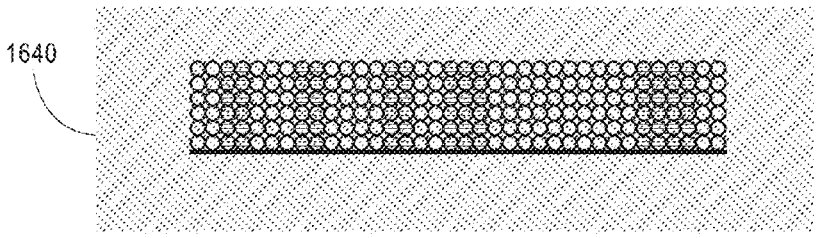

In FIG. 16D, the separation bed with separated molecules (e.g., proteins) is optionally washed and contacted with a matrix composition 1640.

Figure 16E:
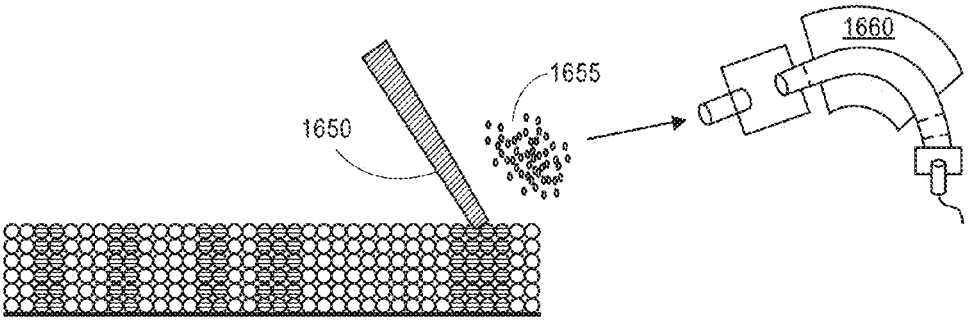

In FIG. 16E, the substrate with the separation bed can be loaded in a MALDI-TOF instrument, where analytes are irradiated with a laser 1650. The resulting analyte ions 1655 are then directed to a TOF mass analyzer 1660 for analysis.

Samples deposited onto the particle bed can be digested prior to being detected by a mass analyzer. Samples that are spotted, or separated by some means (e.g., separated by size, isoelectric point, or both) on the colloidal crystal can be digested. For example, trypsin or another protease can be applied to the surface of the particle bed, producing a digestion of the proteins. The digested samples can then be detected by the mass analyzer.

In other aspects, the proteins in the sample are not digested. For example, in certain instances, glycoprotein mixtures are analyzed without digestion. The methods disclosed herein allow relatively rapid and detailed assessment of glycoproteins (with and without digestion) and oligosaccharide structures. As the methods herein include soft ionization techniques (i.e., providing analyte ions with minimal fragmentation), large glycoproteins are suitable for analysis.

Moreover, the current methods allow for simultaneous separation of multiple samples, such as separation of an array of samples. These methods reduce overall analysis time compared to capillary electrophoresis mass spectrometry (CE-MS). CE-MS requires up to an hour or more per sample and running multiple samples takes several hours. In contrast, the present invention provides simultaneous separation of multiple samples, and thus reduces the overall analysis time. In certain instances, multiple samples are ionized simultaneously or near simultaneously and thus, the separation time of multiple samples is substantially reduced compared to prior art methods.

In certain other aspects, markers or probes (e.g., a protein with a specific molecular weight or a protein ladder) can be used to identify particular locations or zip codes of the separation bed for subsequent ionization. In still other instances, using the methods of the present invention it is possible to combine separation techniques such as first performing an immunoassay to derive functional biology information, followed by mass spectroscopy to derive structural biological information.

When MALDI-TOF MS is used, a separation bed mounted on a suitable substrate is used for resolution of the analytes via electrophoresis. The separation bed with resolved analytes is then introduced into the ion source of the mass spectrometer without removing the resolved analytes from the silica particles in which the electrophoresis was performed. In the methods of the invention, irradiating an analyte generally includes directing a laser beam onto the colloidal silica nanoparticles. One or more of the resolved analytes are thus exposed to laser radiation of a suitable wavelength. Any suitable laser can be used in the methods of the invention. For instance, a nitrogen laser generating 337-nm radiation can be used. In certain aspects, the laser wavelength is selected based on the size of the particles in the separation bed. In other aspects, the size of the particles in the separation bed is selected based on the wavelength of the laser. In certain aspects, the laser beam has a nominal wavelength or set of wavelengths ranging from about 100 nm to about 100 μm, or about 200 nm to about 50 μm, or about 200 nm to about 10 μm. The laser beam can be directed to the resolved analytes using one or more optical components, such as a prism or mirror, and the intensity of the laser beam can be varied using a suitable attenuator. Irradiation of the resolved analytes produces analyte ions that can be separated and analyzed in order to determine the masses of the analyte ions. In certain instances, the laser spot size is between 50 μm and 500 μm depending on the experiment.

A matrix compound can be used to promote the formation of analyte ions. Typical matrices are small molecules having molecular weights below 500 g/mole and absorption spectra overlapping the emission wavelength of the laser employed in the method. Examples of useful matrix compounds include, but are not limited to, sinapinic acid; 2,5-dihydroxybenzoic acid; α-cyano-4-hydroxycinnamic acid; nicotinic acid; 3-hydroxy-picolinic acid; 6-aza-2-thiothymine; 2',4',6'-trihydroxyacetophenone and hydrates thereof; succinic acid; 2-(4'hydroxyphenyl)azobenzoic acid; indoleacrylic acid; 5-chloro-2-mercaptobenzothiazole and glycerol. One of skill in the art will appreciate that mixtures of matrix compounds can also be used. A matrix can be added as a solution to the separation bed with resolved analytes. The solution can contain a solvent such as water, as well as a co-solvent such as acetonitrile or methanol. Acids such as trifluoroacetic acid (TFA) or formic acid can be added to matrix compositions to completely protonate the analytes in a sample, and chelators such as ammonium citrate can be added to bind to ionic species that can otherwise form adducts with analytes and suppress signal. Evaporation of the solvents and co-solvents from the matrix composition typically leads to co-crystallization of the matrix with the analyte.

Analyte ions are subjected to an electric potential gradient in the ionization region of the ion source. An accelerating voltage is applied to the conductive substrate material, and the potential gradient is established using a ground grid voltage. Typical accelerating voltages range from about 15,000 V to about 25,000 V, although other voltages can be used depending in part on the properties of particular analytes and matrices. The potential gradient can be further tuned using a variable grid voltage. The potential gradient is sufficient to accelerate the analyte ions, moving them from the ion source to the TOF mass analyzer. An analyte ion travels through the flight tube of a TOF mass analyzer at a velocity that is inversely proportional to the square root of the mass of the analyte ion. The mass of the analyte ion can therefore be determined based on the time necessary for the analyte ion to traverse the flight tube. A guide voltage can be established in the flight tube to prevent diffusion of the analyte ions and focus them on the detector. The detector measures ion abundance over time and sends signals to a digitizer for further data processing. The detector can include components such as one or more microchannel plates, a scintillator, and a photomultiplier. In general, the methods of the invention can be used to detect analyte ions with mass-to-charge ratios ranging from about 100 (m/z) to about 500,000 (m/z) or higher.

One of skill in the art will understand how to optimize the acquisition of MALDI-TOF mass spectra. Spectral characteristics (such as signal intensity and resolution, as well as signal-to-noise) can be optimized by adjusting parameters such as laser intensity, the number of laser pulses, accelerating voltage, grid voltages, guide voltage, and the delay time between ionization and voltage application. One of skill in the art will also appreciate that additional instrumentation can be used for different analytical modes. For example, a collision cell can be used to fragment certain analyte ions for MS/MS analysis. A reflector analyzer can be used to lengthen the ion flight path and increase resolution.

The mass spectrometry methods of the present invention provide a number of advantages. The methods can provide improved mass resolution. The methods can reduce the occurrence of matrix adduct formation by enabling efficient, homogeneous, co-crystallization of the analyte with the matrix. The methods can provide better tolerance of salts and detergents in sample preparations, reducing the need for purification prior to analysis. The methods can provide increased dynamic range, enabling analysis over higher and lower mass-to-charge ratios than traditional mass spectrometry methods. This can be particularly useful for characterization of small molecules including pharmaceuticals. The silica particles can allow for easier co-crystallization with matrix compositions, promoting better shot-to-shot reproducibility and ionization of more massive particles such as biologics.

Evaluation for biologics, or biological drugs, can be useful for biomarker discovery. And it can be potentially used for better diagnostics for assays requiring small changes in the target protein or protein of interest. A diagnostic kit can be assembled that incorporates multiple elements for diagnostics, such as at a point of care or in a clinical diagnostic laboratory. The kits can evaluate protein levels, concentrations, detect protein biomarkers, etc.

The diagnostic kits described herein can be used to diagnosis diseases or disorders such as, but not limited to, Lyme disease, other tick-borne disease, Creutzfeldt-Jakob Disease, prion disease, HIV infection, HSV infection, HCMV infection, SARS infection, *Helicobacter pylori* infection, *Campylobacter pylori* infection, Parvovirus infection, Hepatitis C infection, Kaposi's sarcoma virus infection, influenza infection, other viral infections, bacterial infection, *Staphylococcus aureus* infection, fungal infection, paraneuplastic syndrome, amyotophic lateral sclerosis (ALS), spinal muscular atrophies (SMA), primary lateral sclerosis (PLS), Arthrogryposis Multiplex Congenita (AMC), Alzheimer's disease, heart failure severity, lung cancer, pancreatic cancer, colorectal cancer, prostate cancer, bladder cancer, gastric cancer, oral cancer, breast cancer, ovarian cancer, lymphoma, metastasis, neoplasia, COPD, kidney disease, Sjogren's syndrome, autism, depression, neuropsychiatric disease, inflammatory disease, autoimmune disease, myasthenia gravis, scleroderma, osteoporosis, and the like. Detailed descriptions of diagnostic method based on western blotting are found in, e.g., U.S. Pat. Nos. 8,962,257; 8,145,112; 8,257,917; 7,709,208; 7,192,698; 6,013,460; and 5,545,534, each of which is incorporated herein by reference.

Prior to analysis by MALDI-MS, analytes can be separated by size or pI as described above. Electrophoretic separation using silica particles can provide better resolution than liquid chromatography, allowing for analysis of more complex protein mixtures than conventional methods. The surface of the silica particles can be modified to promote covalent and/or non-covalent binding, preferably non-covalent binding of analytes during washing or other sample processing steps; certain matrix compositions can then be added to allow for analyte release and desorption. Separations via electrophoresis or chromatography currently require transfer of analytes from the separation medium to the MALDI plate, and separate sample fractions are frequently transferred to separate locations on the plate. In contrast, the present invention allows for separation followed by ionization on the same substrate. MS scanning on the continuously separated analyte can be conducted, and the need for fractionation is eliminated. The efficiency is greatly improved since the analyte does not have to be eluted from the separation medium.

FIGS. 17A-17D illustrate two-dimensional (2D) separation in accordance with an embodiment.

Figure 17A:
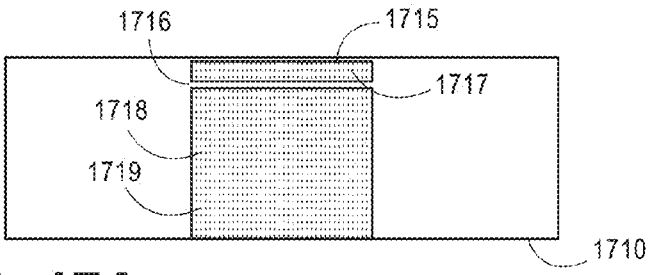
FIGS. 17A-17D illustrate a device and a method for resolution of analytes in two dimensions in accordance with an embodiment.
Figure 17B:
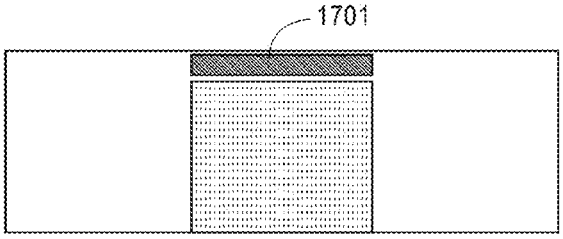
Figure 17C:
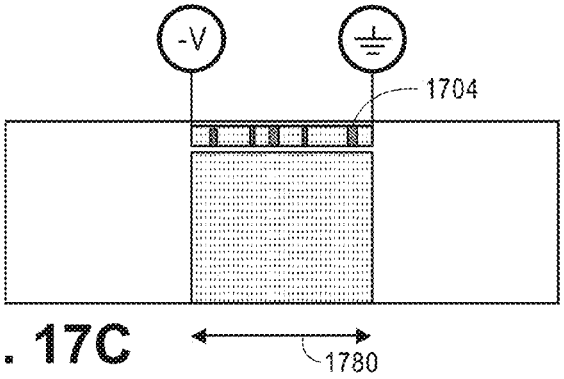
Figure 17D:
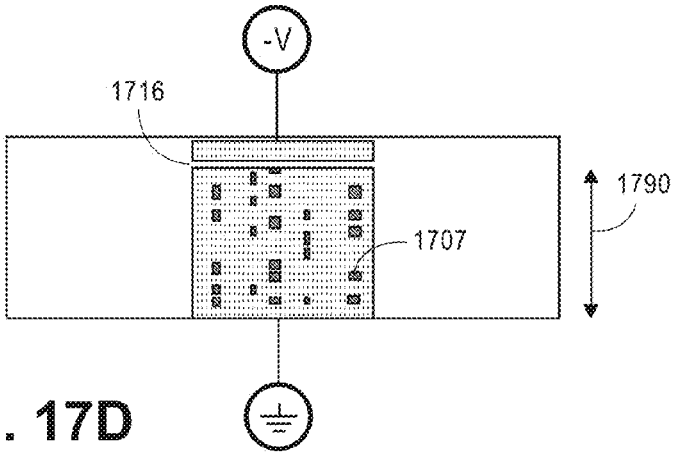

In FIGS. 17A-17C, sample 1701 is loaded and resolved along longitudinal direction 1780 in separation bed 1715 having a plurality of silica particles 1717 so as to form one or more resolved analytes 1704. As a non-limiting example, isoelectric focusing can be used in the longitudinal dimension In FIG. 17D, the first separation in longitudinal direction 1780 is followed by a separation along a second latitudinal dimension 1790 to form one or more analytes 1707 resolved in two dimensions. The separation in the second dimension can be conducted in a second separation bed 1718. A gap 1716 between the separation beds 1715 and 1718 can be filled with a buffer or other suitable solution to enable migration of the resolved analytes 1704 from the first separation bed to the second separation bed. Suitable second dimension separation techniques include, but are not limited to, capillary electrophoresis, thin layer chromatography, high pressure chromatography, size exclusion chromatography and the like.

In certain aspects, binding moieties (e.g., antibodies, aptamers, or other functional groups) can be attached to the silica particles, and then analytes can be resolved via isoelectric focusing in the separation bed. Resolution can be conducted at a higher voltage or for a longer time, if necessary, to ensure that a given analyte migrates to its isoelectric point. When the current is stopped, the non-covalent interactions between the analyte and the binding moieties are sufficient to retain the analytes of interest in the separation bed while unbound analytes are washed away. This approach can also be applied to size-based electrophoretic separation. These modes allow for the analysis of complex protein samples, and can provide further separation of proteins having similar sizes and/or isoelectric points. The methods can be used for analyzing post translational modifications or truncated proteins.

In one aspect, the separation bed can enable multiple "lanes" either as a single, continuous entity in which diffusion does not allow cross-reactivity between lanes, or the silica particles can be printed as individual lanes with a barrier between (if necessary). The biomolecules and a reference standard (such as a molecular weight ladder) can be detected in the separation bed by various means such as an optical means (e.g., fluorescence) in addition to mass spectrometry.

In certain aspects, a colloidal crystal structure is a densely ordered packing of particles in a patterned arrangement with long range order that is generally hundreds of particles long, but may be more or less particles in length, and typically extends in two or three dimensions. A colloidal crystal is most often composed of spherically shaped particles, but may be composed of non-spherical particles as well (*Langmuir* 2007, 23, 8810-8814). A colloidal crystal may be composed of monodisperse particles or may also be composed of multiple particle sizes in an arrangement such that a predictable pattern is created. One of the most common techniques used to create colloidal crystals is Evaporative Induced Self-Assembly (EISA).

In certain aspects, certain particle sizes are particularly suitable for separation of proteins with certain molecular weights. For example, proteins of molecular weight 5-30 kDa are separated with nanoparticles having a diameter of 100 nm to 500 nm. In other aspects, proteins of molecular weight 30-100 kDa are separated with nanoparticles having a diameter of 500 nm to 700 nm. In still other aspects, proteins of molecular weight 100-500 kDa are separated with nanoparticles having a diameter of 700 nm to 1000 nm. Particular particle sizes can be used for separation of low molecular weight proteins, medium molecular weight proteins, or high molecular weight proteins.

Without adhering to any particular theory, the advantages of the present invention are believed to result from the increased surface-to-volume ratio of the silica particles. Packing a channel with silica particles creates many smaller channels for protein migration, while the solid material allows for more efficient heat dissipation. In addition, there are no ultra-small channels that would act as traps to give the smearing of zones that is commonly observed when using polyacrylamide gels. Pore sizes and surface-to-volume ratio can be controlled by the particle diameter, independently of the overall dimensions of the separation apparatus. For example, if particles are packed as body centered cubic with 1 μm diameter, the minimum pore size would be 155 nm and the surface-to-volume ratio would be 13. The increased surface-to-volume ratio improves binding efficiency. The use of silica nanoparticles can reduce unwanted background noise such as autofluorescence during data collection. The use of electrophoresis-driven separation, washing, and probing steps can minimize unwanted pressure drops.

III. Examples

Example 1

One-Dimensional Separation and MALDI-TOF MS Analysis of a Protein Mixture

A glass slide is chemically modified with a solution of n-butyldimethylchlorosilane in anhydrous toluene under nitrogen. The slide is then rinsed with dry toluene and dried under vacuum at 80° C. A 1-mm-wide stripe of 1 cm in length is masked off on the slide and chemically etched with an ammonium bifluoride salt paste. A second, chemically-modified glass slide is used to cover the separation bed, and the assembly is secured using binder clips. A 10% w/w silica colloid is wicked into the separation bed and allowed to dry at room temperature. After drying, the cover glass slide is removed and the packed separation bed is silylated with a polymerization initiator. Linear polyacrylamide chains are grown using a complex of CuCl with tris(2-dimethylamino-ethyl) amine as the catalyst; the slide is immersed in a solution of acrylamide monomer and CuCl catalyst, and the mixture is allowed to polymerize.

The slide with the packed separation bed is wetted with running buffer (25 mM Tris; 192 mM glycine; 0.1% (w/v) SDS; pH 8.0) and covered with a PDMS seal at each end of the separation bed to prevent drying. The separation bed is electrically conditioned at 50 V/cm using a high-voltage power supply until the current becomes static.

Proteins (myoglobin from equine skeletal muscle, cytochrome c from bovine heart and lysozyme from chicken egg white) are dissolved in PBS buffer and combined in a denaturation buffer (62 mM Tris; 1 mM EDTA; 3% sucrose; 2% SDS; pH 8.0). The concentration of each protein is about 0.05 mg/mL. The proteins are denatured at 100° C. for 3 minutes.

Proteins are electrokinetically loaded into the prepared separation bed under 300 V/cm for 30 s. Next, the separation bed is mounted between buffer-filled reservoirs and an electric field of 50 V/cm is used for separation. Following separation, the separation bed is briefly rinsed in deionized water, and the resolved proteins are fixed in the polyacrylamide brush layer using a mixture of methanol, deionized water, and acetic acid (50:45:5, v:v:v). The separation bed is then covered with a small volume of sinapinic acid solution (1 mg/mL in 50:50 acetonitrile:water containing 0.1% TFA), and the solution is allowed to evaporate. The slide with the separation bed is fixed to a sample plate, and the plate is loaded in a Voyager DE-Pro MALDI-TOF instrument. Mass spectra are obtained using a 20,000 V accelerating voltage with grid voltage percentage set at from about 85% to about 90% and guide wire voltage set at about 0.3% voltage. Instrument settings are adjusted to optimize signal intensity and resolution. +1 and +2 charge states are observed for the proteins. Full width at half maximum (FWHM) values for protein signals are greater than 1000, and signal-to-noise ratios are higher than 200:1.

Example 2

Two-Dimensional Separation and MALDI-TOF MS Analysis of a Protein Mixture

A pH gradient is established across a separation bed packed with silica particles (fabricated as described above) using a commercially available carrier ampholyte mixture.

Proteins (myoglobin from equine skeletal muscle, cytochrome c from bovine heart and lysozyme from chicken egg white) are dissolved in PBS and combined in an isoelectric focusing solution (8 M urea; 20 mM DTT; 0.5% Triton X-100). The concentration of each protein is about 0.05 mg/mL.

Proteins are electrokinetically loaded into the prepared separation bed under 300 V/cm for 30 s. Isoelectric focusing is conducted by ramping the voltage from 50 V/cm to 1000 V/cm over a period of time sufficient for separation of the proteins.

The separation bed is aligned with a second separation bed equilibrated with SDS running buffer (25 mM Tris; 192 mM glycine; 0.1% (w/v) SDS; pH 8.0). A voltage of 50 V/cm is applied across the aligned separation beds to separate the proteins according to size.

Following separation, the separation bed is briefly rinsed in deionized water, and the resolved proteins are fixed in the polyacrylamide brush layer using a mixture of methanol, water, and acetic acid (50:45:5, v:v:v). The separation bed is then covered with a small volume of sinapinic acid solution (1 mg/mL in 50:50 acetonitrile:water containing 0.1% TFA), and the solution is allowed to evaporate. The slide with the separation bed is fixed to a sample plate, and the plate is loaded in a Voyager DE-Pro MALDI-TOF instrument. Mass spectra are obtained using a 20,000 V accelerating voltage with grid voltage % set at from about 85% to about 90% and guide wire voltage set at about 0.3% voltage. Instrument settings are adjusted to optimize signal intensity and resolution. +1 and +2 charge states are observed for the proteins. Full width at half maximum (FWHM) values for protein signals are greater than 1000, and signal-to-noise ratios are higher than 200:1.

Example 3

Two-Dimensional Separation and MALDI-TOF MS Analysis of a Protein Mixture

A separation bed packed with silica particles is fabricated as described above, and a first region of the surface (i.e., a first dimension) is isolated from the rest of the crystal (i.e., a second dimension) by creating a physical gap between the two crystal areas or by using a manifold to separate the areas. A pH gradient is established across the isolated region using a commercially available carrier ampholyte mixture.

Proteins (myoglobin from equine skeletal muscle, cytochrome c from bovine heart and lysozyme from chicken egg white) are dissolved in PBS and combined in an isoelectric focusing solution (8 M urea; 20 mM DTT; 0.5% Triton X-100). The concentration of each protein is about 0.05 mg/mL.

The proteins are loaded into the first region of the surface, and isoelectric focusing is conducted by ramping the voltage from 50 V/cm to 1000 V/cm over a period of time sufficient for separation of the proteins.

The second dimension region is equilibrated with SDS running buffer. If a manifold is used to separate the two regions, the manifold is removed. If a physical gap is used, the gap is filled with the SDS running buffer. A voltage is then applied across both regions of the separation bed in a direction perpendicular to the voltage that was applied for the isoelectric focusing step. The proteins are separated by size in the second dimension.

Following separation, the separation bed is briefly rinsed in deionized water, and the resolved proteins are fixed in the polyacrylamide brush layer using a mixture of methanol, water, and acetic acid (50:45:5, v:v:v). The separation bed is then covered with a small volume of sinapinic acid solution (1 mg/mL in 50:50 acetonitrile:water containing 0.1% TFA), and the solution is allowed to evaporate. The slide with the separation bed is fixed to a sample plate, and the plate is loaded in a Voyager DE-Pro MALDI-TOF instrument. Mass spectra are obtained using a 20,000V accelerating voltage with grid voltage % set at from about 85% to about 90% and guide wire voltage set at about 0.3% voltage. Instrument settings are adjusted to optimize signal intensity and resolution. +1 and +2 charge states are observed for the proteins. Full width at half maximum (FWHM) values for protein signals are greater than 1000, and signal-to-noise ratios are higher than 200:1.

Example 4

Protein Separation in a Microchannel Through a Polyacrylamide Coated Silica Colloidal Crystal by Isoelectric Point A 1.8-cm long channel was packed with silica particles that were coated with a polyacrylamide brush layer. The ends of the channel were fitted with reservoirs that could be used for loading the channel and for electrophoresis. A platinum (Pt) electrode was inserted into each reservoir and connected to a power supply. The channel was imaged by placing the chip on an inverted fluorescence microscope, and using fluorescence-labeled proteins in the experiments.

4% Carrier ampholytes pH 3-10, 8 M urea, 2% 3-[(3-cholamidopropyl)dimethylammonio]-1-propanesulfonic (CHAPS) and 50 mM dithiothreitol was applied to the whole channel, along with a mixture of carbonic anhydrase I and II and lectin glycoprotein, all of which were labeled with Alexa Fluor 546. The catholyte reservoir was filled with 20 mM NaOH and the analyte reservoir was filled with 20 mM $H_3PO_4$. The electric field was supplied by a high-voltage power supply to produce approximately 100V/cm. The proteins were allowed to migrate to their isoelectric points, and the channel was imaged with an inverted optical microscope equipped with an excitation source and filter set suitable to image the 546 nm labeled proteins. The channel was opened so that one surface of the entire length of the channel was accessible.

Figure 18:
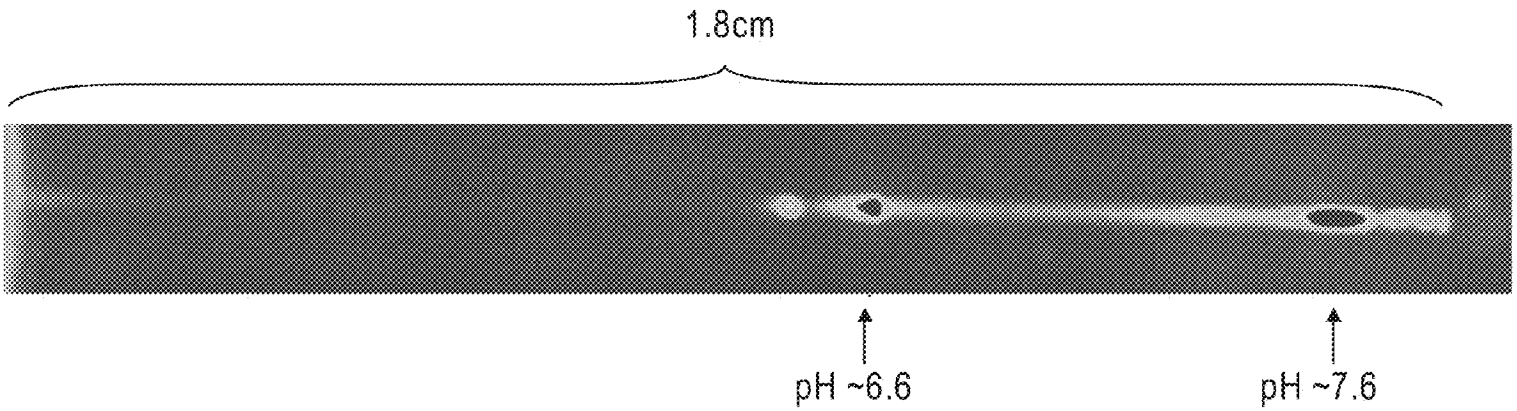
FIG. 18 is an image of isoelectric focusing separation of analytes in a 1.8 cm long microchannel in accordance with an embodiment.

FIG. 18 shows isoelectric (IEF) separation of labeled carbonic anhydrase I and II and lectin glycoprotein in a 1.8 cm long microchannel that is packed with polyacrylamide coated silica beads.

Example 5

MALDI-MS Detection of Protein Mixtures Spotted onto Silica Colloidal Crystal Surface Sub-micrometer silica spherical particles (300 nm) were calcined (desiccated) at 600° C. for 12 hours and then deposited on a clean silicon wafers using a draw-down coater forming a highly-ordered three-dimensional silica colloidal crystal. The silica colloidal crystal was coated with a brush layer of polyacrylamide as follows.

Silica coated silicon wafers were placed face up in a covered glass Petri dish in a fume hood. The silicon wafers were flushed with argon gas for several minutes. Using a syringe and needle, a total of 100 μL, silicon tetrachloride ($SiCl_4$) was placed on the bottom of the dish in several locations and the dish was flushed with argon for one minute. Vapor deposition of the $SiCl_4$ was allowed to take place for 5 minutes. After the vapor deposition was complete, the process was repeated for additional time to ensure sufficient deposition of the $SiCl_4$.

Silica coated silicon wafers were placed in a beaker with 1 mola/liter (M) nitric acid. The 1M nitric acid was heated to reflux for 1 hour. The 1M nitric acid was decanted and the silicon wafers were washed with Milli-Q® water followed by an ethanol wash. The silicon wafers were dried at 60° C. for 24 hours.

The re-hydroxylated silica coated silicon wafers were washed with toluene followed by a 30 minute exposure to a solution of 2% ((chloromethyl)phenyl)trichlorosilane and 0.1% methyltrichlorosilane in toluene. The silicon wafers were then washed with toluene and dried at 120° C. for 3 hours.

The re-hydroxylated and silanized silica coated silicon wafers were washed with water: 2-propanol (1:1) followed by a 3 hour exposure (under argon gas) to a solution of 0.5M acrylamide, 10 mM Copper Chloride, 10 mM tris[2-(dimethylamino)ethyl]amine and 8 mM L-ascorbate in water: 2-propanol (1:1). The silicon wafers were washed with water: 2-propanol (1:1) and then dried at 120° C. for 3 hours.

A mixture of human cytochrome c protein and equine cytochrome c protein was dissolved to a concentration of 0.1 mg/mL using the MALDI matrix which was saturated sinapinic acid in MALDI solvent composed of 70:30:0.1 water: acetonitrile (CAN):trifluoroacetic acid (TFA). Immediately after mixing the proteins with the matrix, 2 μL of the mixture was pipetted onto the silica colloidal crystal surface and the traditional stainless steel MALDI target plates and allowed to dry under atmospheric pressure at room temperature for about 5 minutes.

The samples were analyzed using an Ultraflex III MALDI TOF/TOF mass spectrometer from Brüker Daltonics (Billerica, Mass.) equipped with a neodymium:yttrium aluminium garnet/potassium titanyl phosphate (Nd:YAG/KTP) laser (355 nm, 150 uJ/pulse). The spectra shown in this work were all obtained from 1000-shot accumulations on the different materials.

Figure 20:
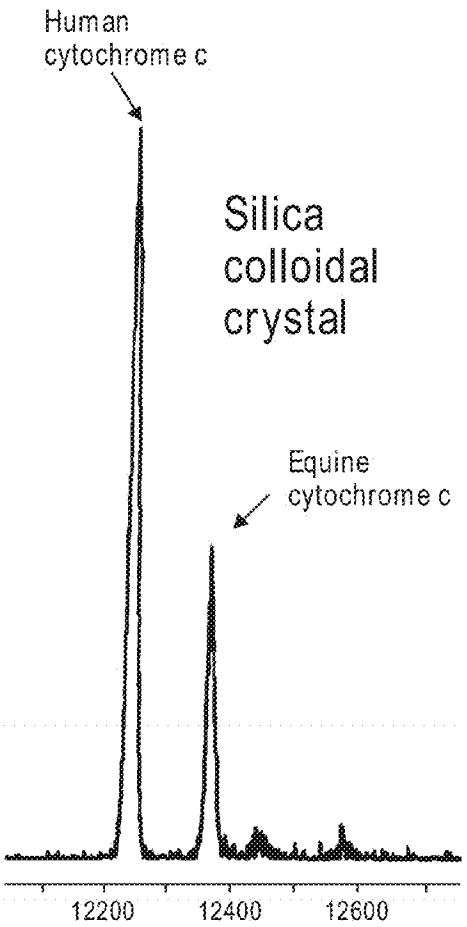
FIG. 20 is a chart of mass spectrometer results from MALDI using a silica colloidal crystal in accordance with an embodiment.
Figure 19:
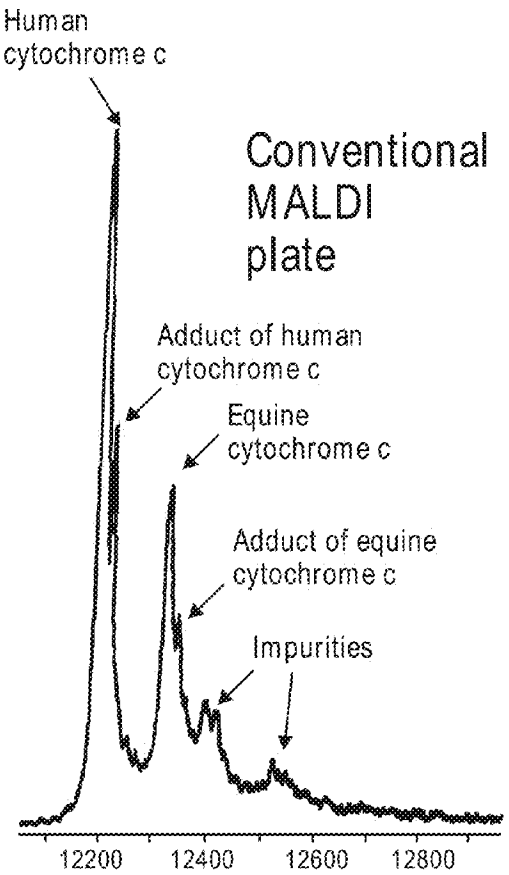
FIG. 19 (PRIOR ART)
FIG. 19 is a chart of mass spectrometer results from MALDI using a conventional stainless steel plate of the prior art.

FIGS. 19-20 presents the resulting MALDI-MS detection traces, which show that the silica colloidal crystal surface (FIG. 20) produced less protein adducts and impurity signals than the traditional stainless steel target plate (FIG. 19) of the prior art.

Figure 21:
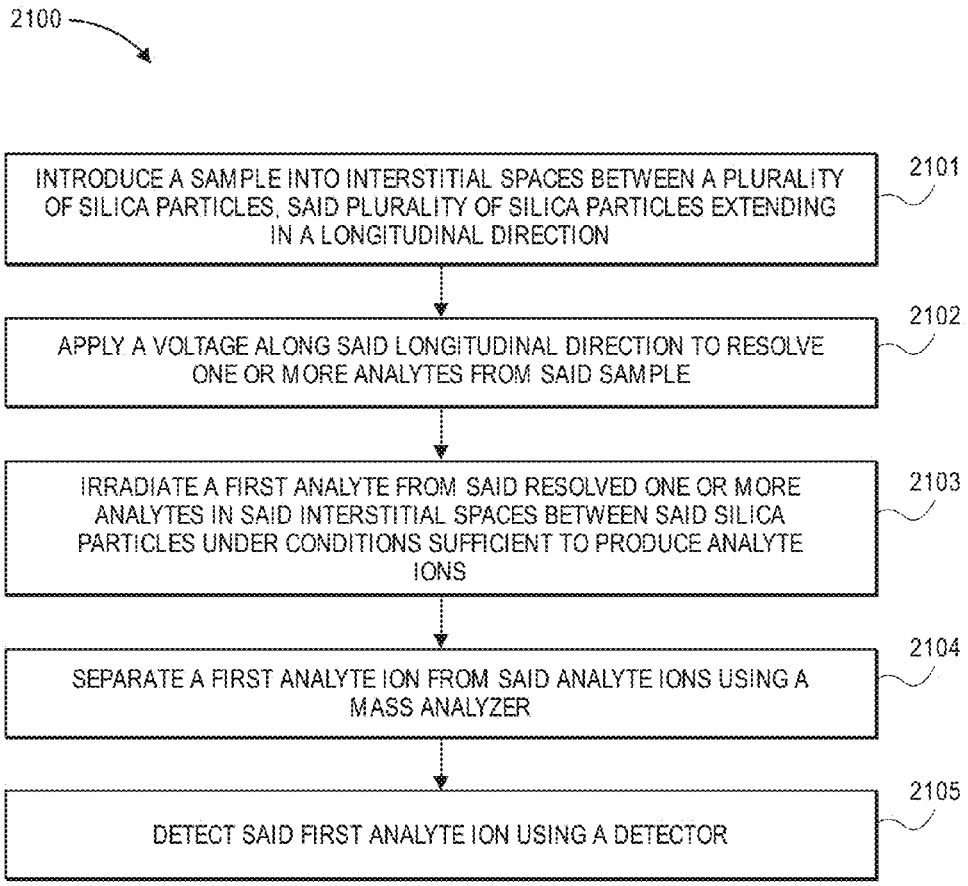
FIG. 21 is a flowchart illustrating a process in accordance with an embodiment.

FIG. 21 is a flowchart illustrating a process 2100 in accordance with an embodiment. In operation 2101, a sample is introduced into interstitial spaces between a plurality of silica particles, said plurality of silica particle extending in a longitudinal direction. In operation 2102, a voltage is applied along said longitudinal direction to resolve one or more analytes from said sample, In operation 2103, a first analyte from said resolved one or more analytes in said interstitial spaces between said silica particles is irradiated under conditions sufficient to produce analyte ions. In operation 2104, a first analyte ion is separated from said analyte ions using a mass analyzer. In operation 2105, said first analyte is detected using a detector.

Figure 22:
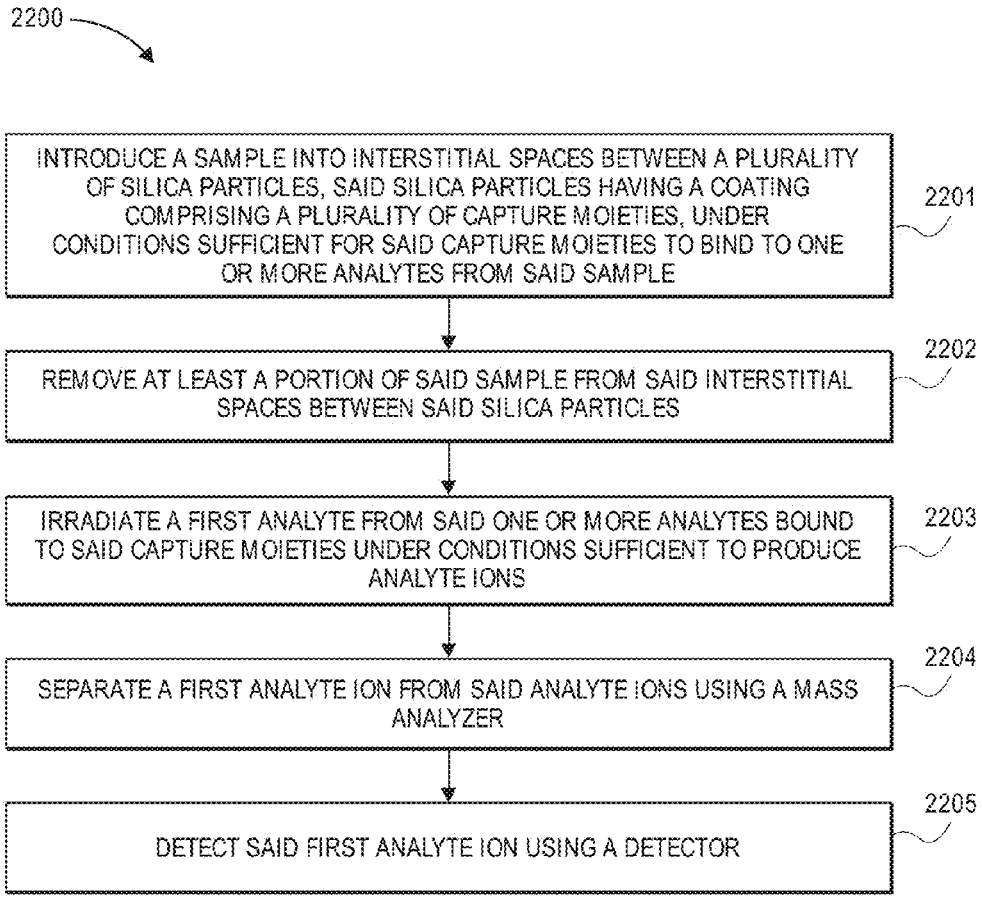
FIG. 22 is a flowchart illustrating a process in accordance with an embodiment.

FIG. 22 is a flowchart illustrating a process 2200 in accordance with an embodiment. In operation 2201, a sample is introduced into interstitial spaces between a plurality of silica particles, said silica particles having a coating comprising a plurality of capture moieties, under conditions for said capture moieties to bind to one or more analytes from said sample. In operation 2202, at least a portion of said sample is removed from said interstitial spaces between said silica particles. In operation 2203, a first analyte from said one or more analytes bound to said capture moieties is irradiated under conditions sufficient to produce analyte ions. In operation 2204, a first analyte is separated from said analyte ions using a mass analyzer. In operation 2205, said first analyte is detected using a detector.

It is understood that the examples and embodiments described herein are for illustrative purposes only and that various modifications or changes in light thereof will be suggested to persons skilled in the art and are to be included within the spirit and purview of this application and scope of the appended claims. All publications, patents, and patent applications, websites, and databases cited herein are hereby incorporated by reference in their entireties for all purposes.

What is claimed is:

1. A mass spectrometry method, said method comprising:

introducing a sample into interstitial spaces between a plurality of silica particles arranged in a regular, body centered cubic crystalline structure, said plurality of silica particles extending in a longitudinal direction;

applying a voltage along said longitudinal direction to resolve one or more analytes from said sample;

irradiating a first analyte from said resolved one or more analytes in said interstitial spaces between said silica particles under conditions sufficient to produce analyte ions;

separating a first analyte ion from said analyte ions using a mass analyzer; and detecting said first analyte ion using a detector.

2. The mass spectrometry method of claim 1, wherein each of said plurality of particles is between about 1 nm and about 2000 nm in diameter.

3. The mass spectrometry method of claim 1, further comprising:

immobilizing said resolved one or more analytes in said interstitial spaces between said silica particles prior to said irradiating.

4. The mass spectrometry method of claim 1, further comprising:

washing said resolved one or more analytes prior to said irradiating.

5. The mass spectrometry method of claim 1, further comprising:

digesting said first analyte with a protease prior to said irradiating.

6. The mass spectrometry method of claim 1, further comprising:

fragmenting said first analyte ion within said mass analyzer prior to said detecting.

7. The mass spectrometry method of claim 1, wherein each of said silica particles comprises a polymeric particle coating.

8. The mass spectrometry method of claim 7, wherein said polymeric particle coating comprises at least one member selected from the group consisting of a polyalcohol, a polyoxyethylene, a polyether, a polyamide, a polyimide, a polycarboxylate, a polysulfate, a polysufonate, a polyphosphate, and a polyphosphonate.

9. The mass spectrometry method of claim 1, wherein said plurality of silica particles further extends in a latitudinal direction, said latitudinal direction extending perpendicularly from said longitudinal direction, the method further comprising:

resolving one or more analytes along said latitudinal dimension using a technique selected from the group consisting of electrophoresis, isoelectric focusing, and chromatography.

10. The mass spectrometry method of claim 1, further comprising:

contacting said silica particles with a matrix composition comprising at least one compound selected from the group consisting of sinapinic acid; 2,5-dihydroxybenzoic acid; α-cyano-4-hydroxycinnamic acid; nicotinic acid; 3-hydroxy-picolinic acid; 6-aza-2-thiothymine; 2',4',6'-trihydroxyacetophenone; succinic acid; 2-(4'hydroxyphenyl)azobenzoic acid; indoleacrylic acid; 5-chloro-2-mercaptobenzothiazole and glycerol.

11. The mass spectrometry method of claim 1, wherein said plurality of silica particles is divided into two or more lanes extending in the longitudinal direction.

12. The mass spectrometry method of claim 11, further comprising:

introducing a first sample into interstitial spaces between a plurality of silica particles in a first lane;

introducing a second sample into interstitial spaces between a plurality of silica particles in a second lane; and applying a voltage along said longitudinal direction to resolve one or more analytes from said first sample and one or more analytes from said second sample.

13. The mass spectrometry method of claim 1, wherein irradiating said first analyte comprises directing a laser beam onto the silica particles.

14. The mass spectrometry method of claim 13, wherein said laser beam has a wavelength ranging from about 200 nm to about 10 μm.

15. The mass spectrometry method of claim 13, wherein irradiating said first analyte comprises raster scanning said silica particles with respect to said laser beam.

16. A mass spectrometry method, said method comprising:

introducing a sample into interstitial spaces between a plurality of silica particles arranged in a regular, body centered cubic crystalline structure, said silica particles having a coating comprising a plurality of capture moieties, under conditions sufficient for said capture moieties to bind to one or more analytes from said sample;

removing at least a portion of said sample from said interstitial spaces between said silica particles;

irradiating a first analyte from said one or more analytes bound to said capture moieties under conditions sufficient to produce analyte ions;

separating a first analyte ion from said analyte ions using a mass analyzer; and detecting said first analyte ion using a detector.

17. The mass spectrometry method of claim 16, wherein each of said plurality of silica particles comprises a polymeric particle coating, wherein said capture moieties are present in said polymeric particle coating.

18. The mass spectrometry method of claim 16, wherein each of said capture moieties is independently selected from the group consisting of an antibody, an antibody fragment, a peptide, a protein, an aptamer, a lectin, a strong cation, a weak cation, a strong anion, a weak anion, a hydrocarbon, and a metal complex.

* * * * *